US005424177A

United States Patent [19]

Kobayashi et al.

[11] Patent Number: 5,424,177

[45] Date of Patent: * Jun. 13, 1995

[54] STABILIZER FOR SILVER HALIDE COLOR PHOTOGRAPHIC LIGHT-SENSITIVE MATERIALS AND ITS CONCENTRATED COMPOSITION, AND PROCESSING METHOD USING SAID STABILIZER

[75] Inventors: Hiroaki Kobayashi; Kenji Kuwae; Moeko Hagiwara, all of Hino, Japan

[73] Assignee: Konica Corporation, Tokyo, Japan

[ * ] Notice: The portion of the term of this patent subsequent to Jan. 11, 2011 has been disclaimed.

[21] Appl. No.: 904,849

[22] Filed: Jun. 26, 1992

[30] Foreign Application Priority Data

Jul. 5, 1991 [JP] Japan ..... 3-165770

[51] Int. Cl.[6] ..... G03C 11/00; G03C 5/18; G03C 5/76; G03C 5/315

[52] U.S. Cl. ..... 430/463; 430/372; 430/418; 430/429; 430/451; 430/490

[58] Field of Search ..... 430/428, 463, 372, 429, 430/451, 607, 642, 450, 621, 623, 626, 631, 636, 637, 551

[56] References Cited

U.S. PATENT DOCUMENTS

| | | | |
|---|---|---|---|
| 3,369,896 | 2/1968 | Seemann et al. | 430/428 |
| 3,565,632 | 2/1971 | Mills et al. | 430/621 |
| 3,667,950 | 6/1972 | Amano et al. | 430/372 |
| 3,762,926 | 10/1973 | Himmelmann et al. | 430/621 |
| 3,879,202 | 4/1975 | Yamaguchi | 430/372 |
| 4,232,113 | 4/1980 | Marchesano | 430/450 |
| 4,268,621 | 5/1981 | Ogi et al. | 430/607 |
| 4,786,583 | 11/1988 | Schwartz | 430/372 |
| 4,859,574 | 8/1989 | Gormel | 430/372 |
| 4,956,268 | 9/1990 | Nakazyo et al. | 430/450 |
| 5,104,775 | 4/1992 | Abe et al. | 430/372 |
| 5,110,716 | 5/1992 | Kuse et al. | 430/429 |
| 5,206,123 | 4/1993 | Ooms et al. | 430/493 |
| 5,278,033 | 1/1994 | Hagiwara et al. | 430/463 |

FOREIGN PATENT DOCUMENTS

| | | | |
|---|---|---|---|
| 761604 | 7/1971 | Belgium | 430/623 |
| 0293011 | 11/1988 | European Pat. Off. . | |
| 2006527 | 12/1969 | France | 430/623 |
| 1919592 | 10/1969 | Germany | 430/451 |
| 1919603 | 10/1969 | Germany | 430/451 |
| 49-62128 | 6/1974 | Japan . | |
| 51-37538 | 10/1976 | Japan . | |
| 55-51172 | 12/1980 | Japan . | |
| 61-151538 | 7/1986 | Japan . | |
| 62-27742 | 2/1987 | Japan . | |
| 4-299340 | 10/1992 | Japan . | |
| 908825 | 10/1962 | United Kingdom | 430/636 |
| 1281619 | 7/1972 | United Kingdom . | |
| 1392134 | 4/1975 | United Kingdom . | |

*Primary Examiner*—Charles L. Bowers, Jr.
*Assistant Examiner*—J. Pasterczyk
*Attorney, Agent, or Firm*—Frishauf, Holtz, Goodman & Woodward

[57] ABSTRACT

Disclosed is a stabilizer for silver halide color photographic light-sensitive materials comprising-at least one compound represented by Formula (I) and at least one compound selected from the group consisting of Formula (II-A), Formula (II-B) and Formula (II-C);

Formula (I)

wherein Z represents a group of atoms necessary to form a substituted or unsubstituted homocycle or a substituted or unsubstituted heterocycle, X represents an aldehyde group, wherein $R_1$ and $R_2$ each represents a lower alkyl group; 1 represents an integer of 1 to 4, $R_1—O—(X_1)_m—(X_2)_n—R_2$ Formula (II-A)

(Abstract continued on next page.)

-continued

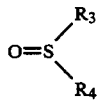

Formula (II-B)

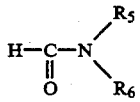

Formula (II-C)

wherein $R_1$ and $R_2$ each represent a hydrogen atom or a lower alkyl group, $X_1$ and $X_2$ each represent an alkyleneoxy group or a branched alkyleneoxy group, m and n each represents 0 or an integer of 1 to 100, provided that $m+n \leqq 100$ is satisfied, $R_3$, $R_4$, $R_5$ and $R_6$ each represents a hydrogen atom, a hydroxyl group, a lower alkyl group, an alkoxyl group, a halogen atom or a hydroxyalkyl group.

13 Claims, No Drawings

STABILIZER FOR SILVER HALIDE COLOR PHOTOGRAPHIC LIGHT-SENSITIVE MATERIALS AND ITS CONCENTRATED COMPOSITION, AND PROCESSING METHOD USING SAID STABILIZER

FIELD OF THE INVENTION

The present invention relates to a stabilizer for silver halide color photographic light-sensitive materials, a concentrated composition of said stabilizer and a processing method using said stabilizer. More specifically, the present invention relates to a processing technique excellent in stability of dye images, excellent in preservability of the concentrated composition, less in stains on the backside of a light-sensitive material, excellent in preservability of a stabilizer and less in flaws on a light-sensitive material subjected to high-speed transferring.

BACKGROUND OF THE INVENTION

In processing color photographic light-sensitive materials for photographing represented by photographic light-sensitive materials containing silver iodobromide as the silver halide, a stabilizer containing formaldehyde is used, in general, in the final processing bath which follows the washing bath.

Formaldehyde used in the stabilizing bath contributes to the improvement in properties of color photographic light-sensitive materials, particularly to the prevention of flaws on the surface of light-sensitive materials and the prevention of gradation changes which are associated with hardening of light-sensitive materials owing to aging. It is also known that formaldehyde has an effect of preventing deterioration in stability of dye images caused by a coupler left unreacted in color light-sensitive materials.

However, formaldehyde added in the stabilizer for the purpose of a stabilized dye image, etc., has a fault of adhering to light-sensitive materials and reacting with sulfite ions brought from the preceding bath to form adducts; this not only impairs the primary object of stabilizing dye images but also accelerates precipitation of sulfur or sulfides.

As a preventive measure against such a problem, U.S. Pat. No. 4,786,583 discloses use of alkanol amines, but alkanol amines are liable to cause yellow stains in unexposed portions and not necessarily satisfactory in preventing sulfur or sulfides from precipitating.

On the other hand, undesirable influences of formaldehyde upon the human body have been disclosed. In the United States, Chemical Industry Institute of Toxicology (CIIT) announced that rats developed naris cancers at a formaldehyde concentration of 15 ppm; National Institute for Occupational Safety and Health (NIOSH) and American Conference of Governmental Industrial Hygientists (ACCIH) also disclosed that formaldehyde might be carcinogenic. Use of formaldehyde is strictly regulated in Europe, too. In Germany, the formaldehyde concentration in residences has been regulated to be not more than 0.1 ppm since 10 years ago.

In Japan, use of formaldehyde is regulated for its toxicity of irritating the mucous membrane by the law for deleterious substances and powerful drugs, regulation to organic solvent toxication, according to the Occupational Safety and Health Law, the regulation on household goods, the regulation on textile goods and plywoods, and the regulation on underwear and baby clothes newly enforced in 1975 by the Ministry of Health and Welfare. Under such circumstances, there has been demanded a technique which enables reduction in amounts of formaldehyde to be used.

As means to make the formaldehyde content in stabilizers substantially zero or to reduce it effectively, there are proposed use of hexahydrotriazine compounds in Japanese Pat. O.P.I. Pub. Nos. 27742/1987 and 151538/1986 and use of N-methylol compounds in U.S. Pat. No. 4,859,574.

Though these hexahydrotriazine compounds can prevent dye images from fading under high temperature and high humidity conditions even when the formaldehyde concentration is substantially zero, these are less effective under low humidity conditions, for example, at a relative humidity not higher than 20%. Moreover, these compounds have a tendency to stain the backside of color light-sensitive materials for photographing due to uneven sagging of a stabilizer used and, further, have a disadvantage of lowering preservability of a stabilizer and are liable to-cause precipitation of sulfur or sulfides, though not so heavy as formaldehyde does; therefore, troubles are apt to arise in the cases of a protracted processing, a small processing amount and a small replenishing amount.

When the above N-methylol compounds are used in place of formaldehyde, these are insufficient not only in preventing fading of dye images and backside stains but also in improving preservability of a stabilizer; moreover, the preservability is noticeably deteriorated if a preventive measure is taken against the fading of dye images.

In a continuous method for processing a large amount of light-sensitive materials in an automatic processor, it is necessary to take a measure for keeping each component of a stabilizer at a constant concentration, in order to avoid deterioration in properties of the stabilizer due to change in concentration of the component. In addition, minimization of the replenishing amount is strongly demanded in recent years from the viewpoints of economy and antipollution.

A stabilizer may be prepared by mixing necessary components when it is used. But in general, to increase efficiency of the preparation, prescribed amounts of processing agents are mixed and dissolved in the form of concentrated solutions beforehand and, at the time of use, these concentrated solutions are mixed with one another and/or diluted with water to a uniform processing solution, which is used as a tank solution or a replenisher.

However, it is found that concentrated compositions containing formaldehyde and N-methylol compounds have a problem in preservability. Further, it is found that, in a high-speed conveyance during the rapid processing with a large-sized automatic processor practiced in recent years, light-sensitive materials become susceptible to flaws because pressure is applied to the lower turn roller in the stabilizing tank of an automatic processor.

PROBLEMS THE INVENTION INTENDS TO SOLVE

Accordingly, the object of the present invention is to provide a stabilizer for a silver halide color photographic light-sensitive material, a concentrated composition of said stabilizer and a method for processing the light-sensitive material, which are improved firstly in capability of preventing color fading under low humidity conditions in the substantial absence of formaldehyde, secondly in preservability of the concentrated composition, thirdly in capability of minimizing stains on the backside of the light-sensitive material, fourthly in capability of minimizing flaws on the light-sensitive material in a high-speed conveyance, and fifthly in safety of working environments.

MEANS TO SOLVE THE PROBLEMS

The present inventors have made a study to achieve the above object and accomplished the present invention.

That is, the stabilizer for silver halide color photographic light-sensitive materials and the concentrated liquid of said stabilizer of the invention contains at least one compound selected from those represented by the following Formula (I) and at least one compound selected from those represented by the following Formula (II-A), (II-B) or (II-C).

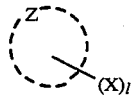

Formula (I)

In the formula, Z represents a group of atoms necessary to form a substituted or unsubstituted carbocycle or a substituted or unsubstituted heterocycle;

X represents an aldehyde group, or

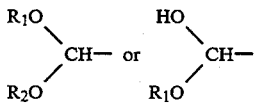

($R_1$ and $R_2$ each represent a lower alkyl group); 1 represents an integer of 1 to 4.

$$R_1-O-(X_1)_m-(X_2)_n-R_2$$ Formula (II-A)

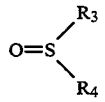

Formula (II-B)

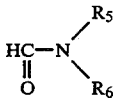

Formula (II-C)

In the formulas, $R_1$ and $R_2$ each represent a hydrogen atom or a lower alkyl group; $X_1$ and $X_2$ each represent an alkyleneoxy group or a branched alkyleneoxy group; m and n each represent 0 or an integer of 1 to 100, provided that $m+n \leqq 100$ is satisfied; $R_3$, $R_4$, $R_5$ and $R_6$ each represent a hydrogen atom, a hydroxyl group, a lower alkyl group, an alkoxy group, a halogen atom or a hydroxyalkyl group.

In a preferable embodiment of the invention, which comprises the above stabilizer for silver halide color photographic light-sensitive materials, the concentrated composition of said stabilizer and the processing method therewith, Z in Formula (I) is a substituted (or unsubstituted) carbocycle or a substituted (or unsubstituted) heterocycle, the stabilizer contains substantially no formaldehyde, the stabilizer contains a water soluble surfactant, and the stabilizer contains a fungicide.

In another preferable embodiment of the invention, the substituent of said Z is a halogen atom, or an aldehyde, hydroxyl, alkyl, aralkyl, alkoxy, nitro, sulfo, carboxyl, amino, hydroxyalkyl, aryl, cyano, aryloxy, acyloxy, acylamino, sulfonamido, sulfamoyl, carbamoyl or sulfonyl group.

CONSTITUTION OF THE INVENTION

The processing method with the processing solution of the invention includes the following processes:

(1) Color developing→bleach-fixing→washing→stabilizing
(2) Color developing→bleaching→fixing→washing→stabilizing
(3) Color developing→bleaching→bleach-fixing→washing →stabilizing
(4) Color developing→bleach-fixing→fixing→washing→stabilizing
(5) Color developing→bleach-fixing→bleach-fixing→washing→stabilizing
(6) Color developing→fixing-bleach-fixing→washing→stabilizing
(7) Color developing→bleaching→bleach-fixing→fixing →washing→stabilizing
(8) Black-and-white developing→washing→reversing→color developing→washing→conditioning→bleaching →fixing→washing→stabilizing
(9) Black-and-white developing→washing→reversing→color developing→washing→conditioning→bleach-fixing →washing→stabilizing
(10) Color developing→bleach-fixing→stabilizing
(11) Color developing→bleaching→fixing→stabilizing
(12) Color developing→bleaching→bleach-fixing→stabilizing
(13) Color developing→bleach-fixing→fixing→stabilizing
(14) Color developing→bleach-fixing→bleach-fixing→stabilizing
(15) Color developing→fixing→bleach-fixing→stabilizing
(16) Color developing→bleaching→bleach-fixing→fixing →stabilizing
(17) Black-and-white developing→washing→reversing color developing→washing→conditioning→bleaching fixing→stabilizing
(18) Black-and-white developing→washing→reversing color developing→washing→conditioning→bleach-fixing →stabilizing Among the above processes, the present invention can be advantageously applied to (1), (2), (8), (10), (11) and (17), more advantageously to (2), (8), (11) and (17) and most advantageously to (11).

That is, the most advantageous embodiment of the invention is to process a light-sensitive material with a stabilizer after the processing with a processing solution having a bleaching capability and/or a processing solution having a fixing capability, preferably immediately after the processing with a processing solution having a fixing capability. The term "a processing solution having a bleaching capability" used in the invention indicates a bleacher or a bleach-fixer employed in the above processes, and "a processing solution having a fixing capability" means a fixer or a bleach-fixer.

Next, the compound of Formula (I) used in the invention is described. In Formula (I), Z represents a group of atoms necessary to form a substituted or unsubstituted carbocycle or a substituted or unsubstituted heterocycle, each of which may be either a monocycle or a condensed ring. Preferably, Z is an aromatic carbocycle or an aromatic heterocycle each having a substituent. Preferred examples of the substituent include aldehyde group, hydroxyl group, alkyl groups (e.g., methyl, ethyl, methoxyethyl, benzyl, carboxymethyl, sulfopropyl), aralkyl groups, alkoxy groups (e.g., methoxy, ethoxy, methoxyethoxy), halogen atoms, nitro group, sulfo group, carboxyl group, amino groups (e.g., N,N-dimethylamino, N-ethylamino, N-phenylamino), hydroxyalkyl groups, aryl groups (e.g., phenyl, p-methoxyphenyl), cyano group, aryloxy groups (e.g., phenoxy, p-carboxyphenyl), acyloxy groups, acylamino groups, sulfonamido group, sulfamoyl groups (e.g., N-ethylsulfamoyl, N,N-dimethylsulfamoyl), carbamoyl groups (e.g., carbamoyl, N-methylcarbamoyl, N,N-tetramethylenecarbamoyl) and sulfonyl groups (e.g., methanesulfonyl, ethanesulfonyl, benzenesulfonyl, p-toluenesulfonyl).

The carbocycle represented by Z is preferably a benzene ring, and the heterocycle represented by Z is preferably a 5-membered or 6-membered heterocycle. Examples of the 5-membered one include thiophene, pyrrole, furan, thiazole, imidazole, pyrazole, succinimide, triazole, tetrazole; examples of the heterocycle include pyridine, pyrimidine, triazine, thiazine; and examples of the condensed ring include naphthalene, benzofuran, indole, thionaphthalene, benzimidazole, benzotriazole, quinoline.

The compounds represented by Formula (I) are exemplified below:

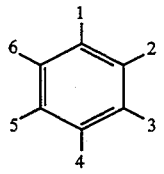

As shown below, exemplified compounds (1) to (48) are obtained by introducing substituents to 1- to 6-positions of the above structure:

| No. | 1 | 2 | 3 | 4 | 5 | 6 |
|---|---|---|---|---|---|---|
| (1) | —CHO | H | H | H | H | H |
| (2) | —CHO | H | H | —OH | H | H |
| (3) | —CHO | H | —OH | H | H | H |
| (4) | —CHO | —OH | H | H | H | H |
| (5) | —CHO | —OH | H | —OH | H | H |
| (6) | —CHO | H | —OH | H | —OH | H |
| (7) | —CHO | —OH | —OH | H | H | H |
| (8) | —CHO | H | —CHO | H | —OH | H |
| (9) | —CHO | H | —CHO | H | H | —OH |
| (10) | —CHO | —OH | —CHO | H | H | H |
| (11) | —CHO | H | —CHO | H | —CHO | H |
| (12) | —CHO | —OH | —CHO | H | —CHO | H |
| (13) | —CH($OCH_3$)$_2$ | H | —OH | H | H | H |
| (14) | —CH($OCH_3$)$_2$ | H | H | —OH | H | H |
| (15) | —CH($OCH_3$)$_2$ | H | —OH | H | —OH | H |
| (16) | —CHO | H | —$NO_2$ | H | H | H |
| (17) | —CHO | H | H | —$NO_2$ | H | H |
| (18) | —CHO | —$NO_2$ | H | H | H | H |
| (19) | —CHO | H | —$NO_2$ | H | —$NO_2$ | H |
| (20) | —CHO | H | H | —$OCH_3$ | H | H |
| (21) | —CHO | H | —$OCH_3$ | H | —OH | H |
| (22) | —CHO | H | —OH | —$OCH_3$ | H | H |
| (23) | —CHO | H | —$OCH_3$ | —OH | H | H |
| (24) | —CHO | H | —OH | —$OCH_3$ | —OH | H |
| (25) | —CHO | H | Cl | H | H | H |
| (26) | —CHO | H | H | Cl | H | H |
| (27) | —CHO | H | Cl | H | Cl | H |
| (28) | —CHO | H | —COOH | —COOH | H | H |
| (29) | —CHO | H | Br | H | H | H |
| (30) | —CHO | H | H | Br | H | H |
| (31) | —CHO | H | OH | —$SO_3H$ | H | H |
| (32) | —CHO | H | H | —$NH_2$ | H | H |
| (33) | —CHO | H | H | —N($CH_3$)$_2$ | H | H |
| (34) | —CHO | H | H | —N($C_2H_5$)$_2$ | H | H |
| (35) | —CHO | H | H | —$CONH_2$ | H | H |
| (36) | —CHO | H | H | —$SO_2NH_2$ | H | H |
| (37) | —CHO | H | H | —$SO_3H$ | H | H |
| (38) | —CHO | H | H | —CN | H | H |
| (39) | —CHO | H | H | —$COOCH_3$ | H | H |
| (40) | —CHO | H | H | —COOH | H | H |
| (41) | —CHO | H | —$SO_3H$ | H | H | H |
| (42) | —CHO | H | —COOH | H | H | H |
| (43) | —CHO | H | —CN | H | H | H |
| (44) | —CHO | H | —$COOCH_3$ | H | H | H |
| (45) | —CHO | H | —$CONH_2$ | H | H | H |
| (46) | —CH(OH)($OCH_3$) | H | —OH | H | H | H |

-continued
| No. | 1 | 2 | 3 | 4 | 5 | 6 |
|---|---|---|---|---|---|---|
| (47) | 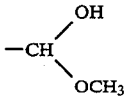 | H | H | —OH | H | H |
| (48) | —CHO | H | —OH | $—CH_3$ | H | H |
| (49) | 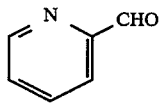 | | | | | |
| (50) | 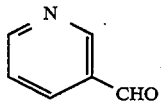 | | | | | |
| (51) | 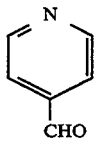 | | | | | |
| (52) | 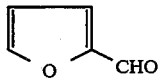 | | | | | |
| (53) | 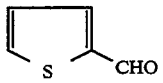 | | | | | |
| (54) | 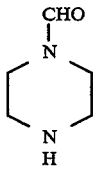 | | | | | |
| (55) | 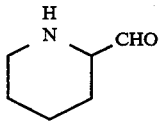 | | | | | |
| (56) | 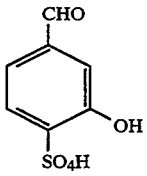 | | | | | |
| (57) | 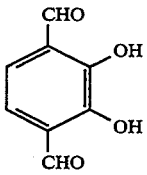 | | | | | |
| (58) | 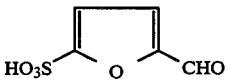 | | | | | |
| (59) | 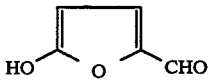 | | | | | |

-continued
| No. 1 | 2 | 3 | 4 | 5 | 6 |
|---|---|---|---|---|---|
| (60) | 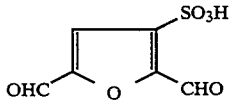 | | | | |
| (61) | 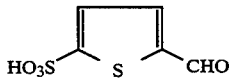 | | | | |
| (62) | 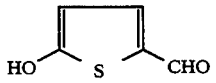 | | | | |
In addition to the above, usable compounds of Formula (I) also include compounds (63) to (90) exemplified on pages 13–14 of Japanese Pat. Appl. No. 89686/1991. Compounds (63) to (90) are reproduced below
(63)
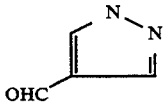
(64)
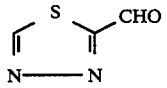
(65)
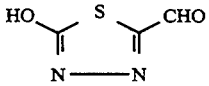
(66)
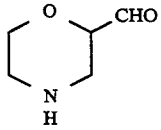
(67)
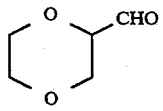
(68)
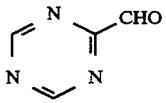
(69)
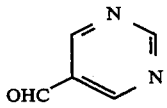
(70)
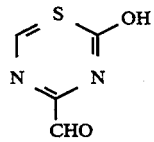
(71)
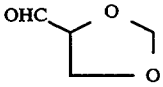
-continued
(72)
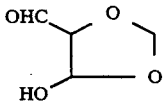
(73)
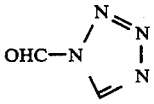
(74)
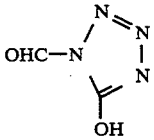
(75)
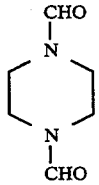
(76)
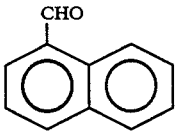
(77)
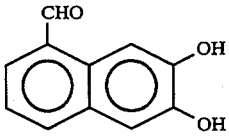
(78)
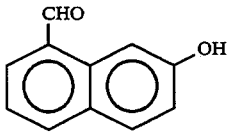
(79)
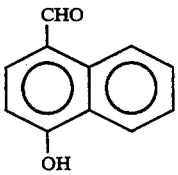

-continued (80)

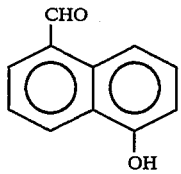

(81)

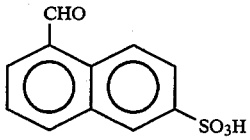

(82)

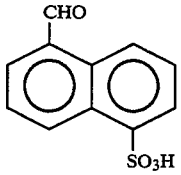

(83)

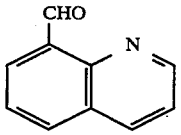

(84)

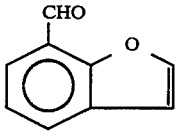

(85)

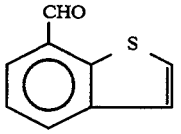

(86)

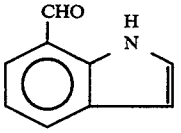

(87)

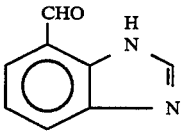

(88)

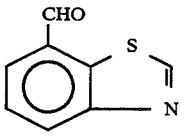

(89)

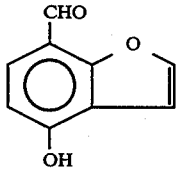

-continued (90)

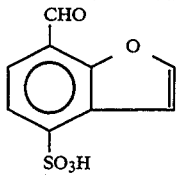

The compound represented by Formula (I) is contained in a stabilizer for silver halide color photographic light-sensitive materials. Further, it may also be contained in a processing solution used jointly with a stabilizer in the bath preceding a processing bath having a bleaching capability, in a processing solution having a bleaching capability, or in a processing solution having a fixing capability within the limits not to give an undesirable influence on the effect of the invention. The compound represented by Formula (I) is used in an amount of 0.05 to 20 g, preferably 0.1 to 15 g, especially 0.5 to 10 g per liter of stabilizer. The compound represented by Formula (I) is characterized in that it provides a better image preservability than formalin does even under low humidity conditions.

Next, the compound represented by Formula (II-A), (II-B) or (II-C) (hereinafter occasionally referred to as the compound of Formula (II)) is described.

$R_1$ and $R_2$ each are a hydrogen atom or a lower alkyl group; preferably a hydrogen atom, or a methyl, ethyl, propyl, butyl or pentyl group.

$X_1$ and $X_2$ each are an alkyleneoxy group or a branched alkyleneoxy group; preferably an ethyleneoxy, trimethleneoxy or propyleneoxy group.

$R_3$ to $R_6$ each are a hydrogen atom, a lower alkyl group, a hydroxyl group, an alkoxy group, a halogen atom, a hydroxyalkyl group, an ethyl group, a methoxy group, a hydroxyl group or a hydroxymethyl group; preferably a hydrogen atom or a methyl group.

The following are preferable examples of the compound represented by Formula (II-A), (II-B) or (II-C):

II-1 $CH_3OH$
II-2 $C_2H_5OH$
II-3 $CH_3CH_2CH_2OH$
II-4 $CH_3CH(CH_3)OH$
II-5 $HOCH_2CH_2OH$
II-6 $HOCH_2CH_2OCH_3$
II-7 $HOCH_2CH_2OCH_2CH_3$
II-8 $HOCH_2CH_2OCH_2CH_2CH_3$
II-9 $HOCH_2CH_2OCH_2CH_2CH_2CH_3$
II-10 $CH_3OCH_2CH_2OCH_3$
II-11 $C_2H_5OCH_2C_2H_2OC_2H_5$
II-12 $C_3H_7OCH_2CH_2OC_3H_7$
II-13 $C_4H_9OCH_2CH_2OC_4H_9$
II-14 $CH_3OCH_2CH_2OC_2H_5$
II-15 $CH_3OCH_2CH_{20}C_3H_7$
II-16 $CH_3OCH_2CH_{20}C_4H_9$
II-17 $C_2H_5OCH_2CH_2OC_3H_7$
II-18 $HOCH_2CH_2OCH_2CH_2OH$
II-19 $HOCH_2CH_2OCH_2CH_2OCH_3$
II-20 $HOCH_2CH_2OCH_2CH_2OC_2H_5$
II-21 $HOCH_2CH_2OCH_2CH_2OC_3H_7$
II-22 $HOCH_2CH_2OCH_2CH_2OC_4H_9$
II-23 $CH_3OCH_2CH_2OCH_2CH_2OCH_3$
II-24 $C_2H_5OCH_2CH_2OCH_2CH_2OC_2H_5$
II-25 $C_3H_7OCH_2CH_2OCH_2CH_2OC_3H_7$

II-26 $C_4H_9OCH_2CH_2OCH_2CH_2OC_4H_9$
II-27 $CH_3OCH_2CH_2OCH_2CH_2OC_2H_5$
II-28 $CH_3OCH_2CH_2OCH_2CH_2OC_3H_7$
II-29 $CH_3OCH_2CH_2OCH_2CH_2OC_4H_9$
II-30 $C_2H_5OCH_2CH_2OCH_2CH_2OC_3H_7$
II-31 $HOCH_2CH_2CH_2OH$
II-32 $HOCH_2CH_2CH_2OCH_3$
II-33 $HOCH_2CH_2CH_2OC_2H_5$
II-34 $CH_3OCH_2CH_2CH_2OCH_3$
II-35 $HOCH_2CH_2CH_2OC_3H_7$
II-36 $HOCH_2CH_2CH_2CH_2OH$
II-37 $HOCH_2CH_2OCH_2CH_2OCH_2CH_2OH$
II-38 $HOCH_2CH_2CH_2CH_2CH_2OH$
II-39 $HOCH_2CH_2OCH_2CH(OH)CH_2OH$

II-40 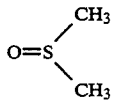

II-41 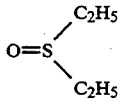

II-42 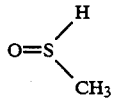

II-43 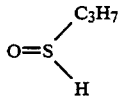

II-44 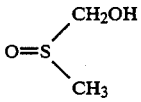

II-45 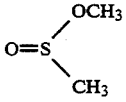

II-46 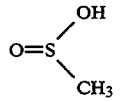

II-47 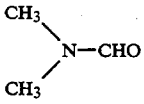

II-48 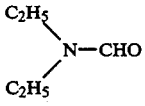

II-49 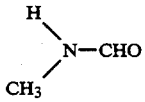

II-50 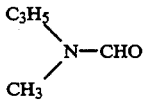

-continued

II-51 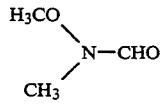

II-52 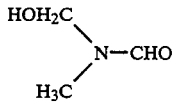

It is preferable that the stabilizer of the invention contain a water-soluble surfactant. As such a surfactant, there is preferably used at least one compound selected from the compounds represented by the following Formula (SI) or (SII) and water-soluble organic siloxane compounds, taking the effect of the invention into consideration.

Formula (SI)

$$R^1X(E^1)_{l1}-(E^2)_{m1}-(E^3)_{n1}-R^2$$

In the formula, $R^1$ represents a hydrogen atom, an aliphatic group or an acyl group; $R^2$ represents a hydrogen atom or an aliphatic group; $E^1$ represents an ethyleneoxy group, $E^2$ a propyleneoxy group and $E^3$ an ethyleneoxy group; X represents an oxygen atom or a $-R^3N-$ group, provided that $R^3$ is an aliphatic group, a hydrogen atom or a $$-(E^1)_{l2}-(E^2)_{m2}-(E^3)_{n2}-R^4,$$

where $R_4$ is a hydrogen atom or an aliphatic group; $l_1$, $l_2$, $m_1$, $m_2$, $n_1$ and $n_2$ each represent a value of 0 to 300.

Formula (SII)

$$A_2-O-(B)_m-(C)_n-X_1$$

In the formula, $A_2$ represents a monovalent organic group, for example, an alkyl group having 6 to 50 carbon atoms, preferably 6 to 35 carbon atoms (e.g., hexyl, heptyl, octyl, nonyl, decyl, undecyl, dodecyl) or an aryl group substituted with an alkyl group having 3 to 34 carbon atoms or with an alkenyl group having 2 to 35 carbon atoms.

The substituent to be introduced to the aryl group is preferably an alkyl group having 1 to 18 carbon atoms (e.g., an unsubstituted alkyl group such as a methyl, propyl, butyl, pentyl, hexyl, heptyl, octyl, nonyl, decyl, undecyl or dodecyl group), a substituted alkyl group such as a benzyl or phenethyl group, or an alkenyl group having 2 to 20 carbon atoms (e.g., an unsubstituted alkenyl group such as an oleyl, cetyl or allyl group, or a substituted alkenyl group such as a styryl group). The aryl group is biphenyl or phenyl group, preferably a naphthyl group. The substituting position on the aryl group may be any of ortho-, meta- and para positions; and plural groups may be substituted.

B or C represents an ethyleneoxy group, a propyleneoxy group or $$-(CH_2)_{n1}-\underset{\underset{OH}{|}}{(CH)}_{m1}-(CH_2)_{l1}-O-$$

($n_1$, $m_1$ and $l_1$ are each 0, 1, 2 or 3). m and n each represent an integer of 0 to 100. $X_1$ represents a hydrogen atom, an alkyl group, an aralkyl group or an aryl group;

examples thereof include those groups which are defined for $A_2$.

Typical examples of the compound represented by Formula (SI) or (SII) are shown below:

Compounds represented by Formula (SI)

$C_{12}H_{25}COO-(C_2H_4O)_{10}-H$ SI-1

$C_9H_{19}COO-(C_2H_4O)_4-H$ SI-2

$C_{12}H_{25}NH-(C_2H_4O)_{10}-H$ SI-3

$C_{12}H_{25}NH-(C_2H_4O)_{15}-H$ SI-4

$HO-(C_2H_4O)-_{20}(CH(CH_3)CH_2O)_5-(C_2H_4O)_{20}-H$ SI-5

$C_{12}H_{25}-NHCH_2CH_2OH$ SI-6

$C_{12}H_{25}-N(CH_2CH_2O)_{10}-H)(CH_2CH_2O)_{10}-H$ SI-7

$C_{12}H_{25}-N(CH_2CH_2O)_5-H)(CH_2CH_2O)_5-H$ SI-8

$HO-(CH(CH_3)CH_2O)-_{16.4}(CH_2CH_2O)_{21.6}-H$ SI-9

$HO-(CH(CH_3)CH_2O)-_{16.4}(CH_2CH_2O)_{14.4}-H$ SI-10

$HO-(CH(CH_3)CH_2O)-_{20.7}(CH_2CH_2O)_{18.2}-H$ SI-11

$HO-(CH(CH_3)CH_2O)-_{30.2}(CH_2CH_2O)_{26.5}-H$ SI-12

$HO-(CH(CH_3)CH_2O)-_{30.2}(CH_2CH_2O)_{39.8}-H$ SI-13

$HO-(CH(CH_3)CH_2O)-_{30.2}(CH_2CH_2O)_{159.1}-H$ SI-14

$HO-(CH(CH_3)CH_2O)-_{35.3}(CH_2CH_2O)_{48.6}-H$ SI-15

$HO-(CH(CH_3)CH_2O)-_{35.3}(CH_2CH_2O)_{108.7}-H$ SI-16

$HO-(CH(CH_3)CH_2O)-_{38.8}(CH_2CH_2O)_{34.1}-H$ SI-17

$HO-(CH(CH_3)CH_2O)-_{38.8}(CH_2CH_2O)_{51.1}-H$ SI-18

$HO-(CH(CH_3)CH_2O)-_{38.8}(CH_2CH_2O)_{119.3}-H$ SI-19

$HO-(CH(CH_3)CH_2O)-_{38.8}(CH_2CH_2O)_{204.5}-H$ SI-20

$HO-(CH(CH_3)CH_2O)-_{47.4}(CH_2CH_2O)_{41.7}-H$ SI-21

-continued $HO-(CH(CH_3)CH_2O)-_{56.0}(CH_2CH_2O)_{31.7}-H$ SI-22

$HO-(CH(CH_3)CH_2O)-_{56.0}(CH_2CH_2O)_{49.2}-H$ SI-23

$HO-(CH(CH_3)CH_2O)-_{56.0}(CH_2CH_2O)_{73.9}-H$ SI-24

$HO-(CH(CH_3)CH_2O)-_{56.0}(CH_2CH_2O)_{295.5}-H$ SI-25

Compounds represented by Formula (SII)

$C_{12}H_{25}-O-(C_2H_4O)_{10}-H$ SII-1

$C_8H_{17}-O-(C_3H_6O)_{15}-H$ SII-2

$C_9H_{19}-O-(C_2H_4O)_4-H$ SII-3

$C_{10}H_{21}-O-(C_2H_4O)_{15}-H$ SII-4

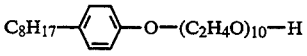
SII-5

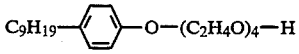
SII-6

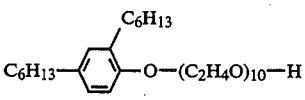
SII-7

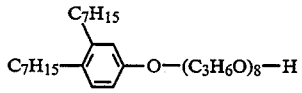
SII-8

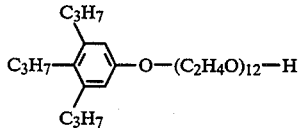
SII-9

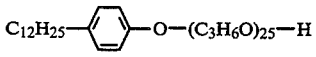
SII-10

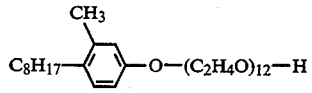
SII-11

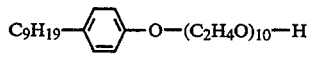
SII-12

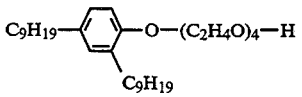
SII-13

$C_{12}H_{25}O-(C_2H_4O)_4-H$ SII-14

$C_6H_{13}-O-(C_2H_4O)_{10}-H$ SII-15

$C_8H_{17}-O-(C_2H_4O)_{15}-H$ SII-16

$C_{10}H_{21}-O-(C_2H_4O)_{10}-H$ SII-17

$C_{12}H_{25}-O-(C_2H_4O)_{15}-H$ SII-18

$C_{14}H_{29}-O-(C_2H_4O)_{15}-H$ SII-19

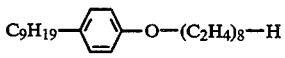
SII-20

-continued
SII-21
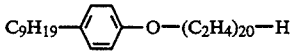
SII-22
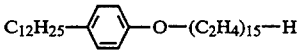
SII-23
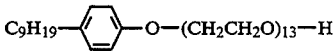
SII-24
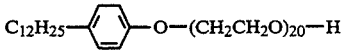
SII-25
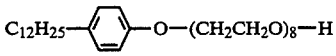
SII-26
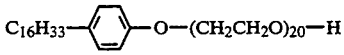
SII-27
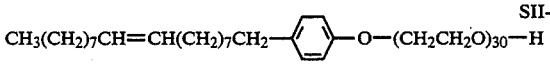
SII-28
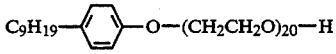
SII-29
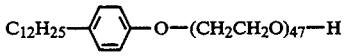
SII-30
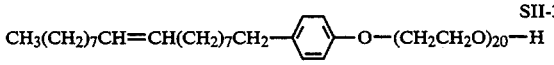
SII-31
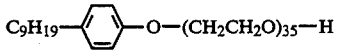
SII-32
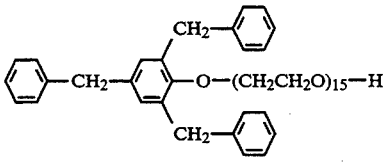
SII-33
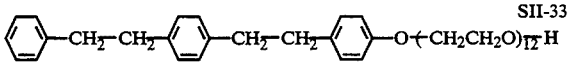
SII-34
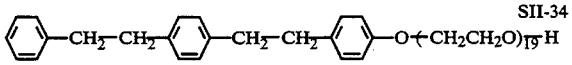
SII-35
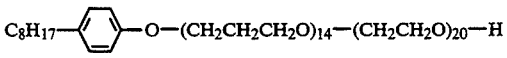
SII-36
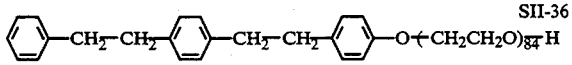
SII-37
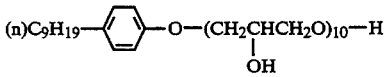
SII-38
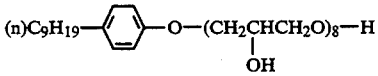
SII-39
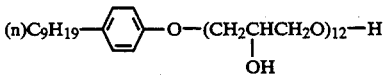
-continued
SII-40
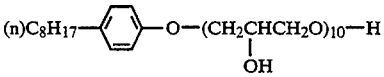
SII-41
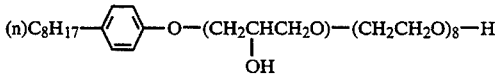
SII-42
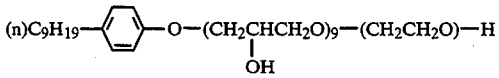
SII-43
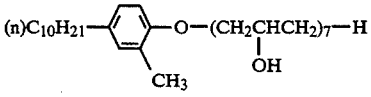
SII-44
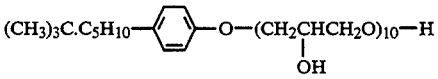
SII-45
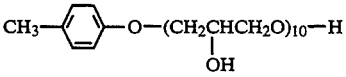
SII-46 $(n)C_{13}H_{27}-O-(CH_2CH_2O)_6-H$
SII-47 $C_{12}H_{25}-O-(CH_2CH_2O)_{10}-H$
SII-48 $C_{18}H_{37}-O-(CH_2CH_2O)_{10}-H$
SII-49 $(n)C_{10}H_{21}-O-(CH_2CH_2O)_4-H$
SII-50 $(n)C_{16}H_{33}-O-(CH_2CH_2O)_4-H$
SII-51
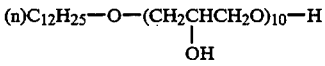
SII-52
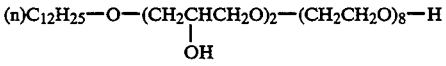
SII-53 $(n)C_{13}H_{27}-O-(CH_2CH_2O)_4-H$
SII-54
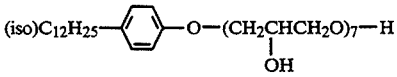
SII-55
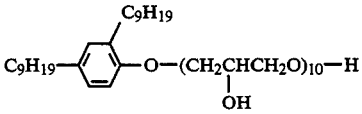
SII-56
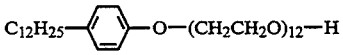
SII-57
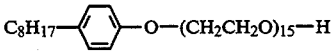
SII-58
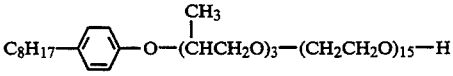
SII-59
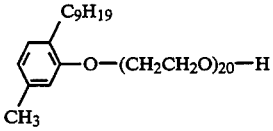
SII-60
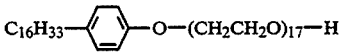

-continued

SII-61

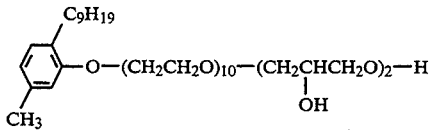

SII-62

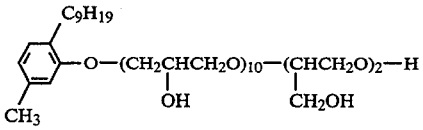

SII-63

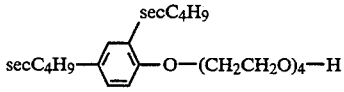

SII-64

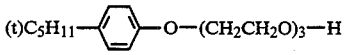

SII-65

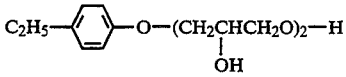

SII-66

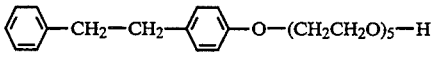

SII-67

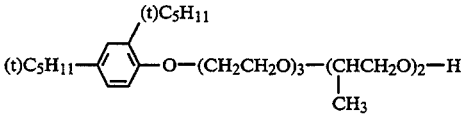

SII-68

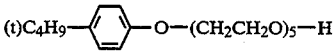

SII-69

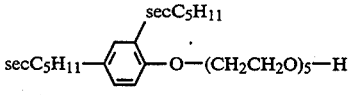

SII-70

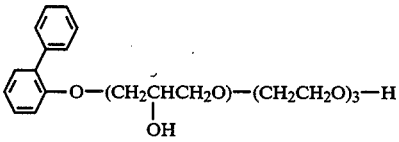

SII-71

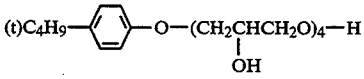

SII-72

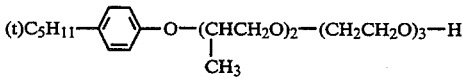

SII-73

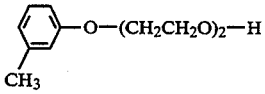

SII-74

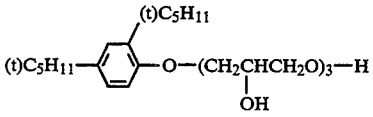

-continued

SII-75

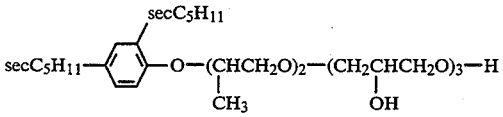

SII-76

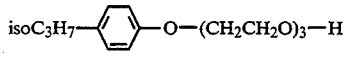

SII-77

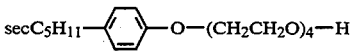

SII-78

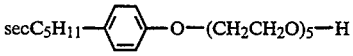

The addition amount of the compounds SII-23 to SII-78 (water soluble surfactants) exemplified on pages 25–32 of Japanese Pat. Appl. No. 89686/1991 (and reproduced above) is preferably 0.1 to 40 g, especially 0.3 to 20 g per liter of stabilizer.

As the water soluble organic siloxanes, compounds represented by the following Formula (SU-I) are preferred.

Formula (SU-I)

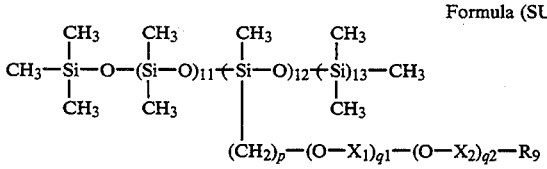

In the formula, $R_9$ represents a hydrogen atom, a hydroxyl group, a lower alkyl group, an alkoxy group,

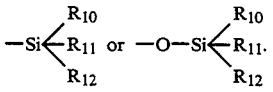

$R_{10}$, $R_{11}$ and $R_{12}$ may be the same or different and each represent a hydrogen atom or a lower alkyl group. $l_1$ to $l_3$ each represents 0 or an integer of 1 to 30; and p, $q_1$ and $q_2$ each represent 0 or an integer of 1 to 30. $X_1$ and $X_2$ each represent —$CH_2CH_2$—, —$CH_2CH_2CH_2$—,

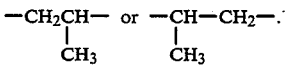

Typical examples of the compound represented by Formula (SU-I) include the following. Water soluble organic siloxanes

SU-I-1

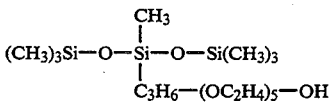

SU-I-2

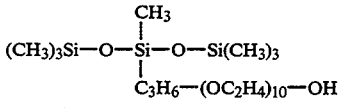

SU-I-3

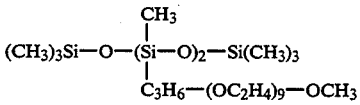

-continued

SU-I-4

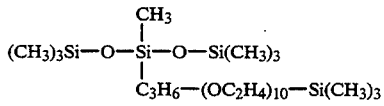

SU-I-5

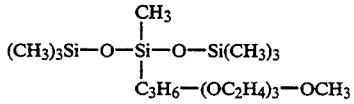

SU-I-6

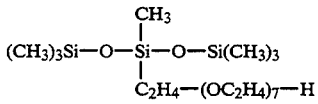

SU-I-7

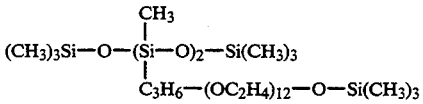

SU-I-8

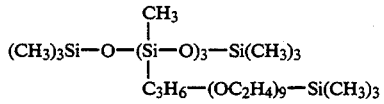

SU-I-9

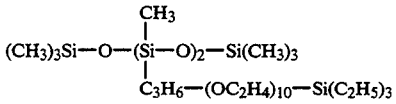

SU-I-10

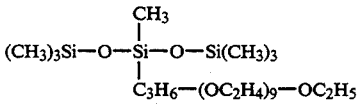

SU-I-11

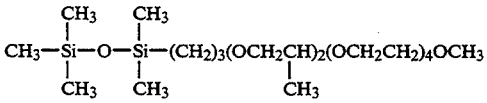

SU-I-12

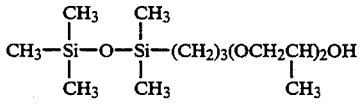

SU-I-13

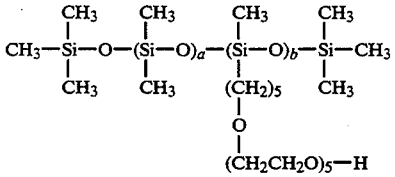

a + b = 30

SU-I-14

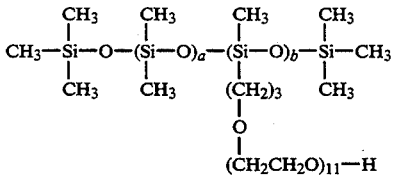

a + b = 41

SU-I-15

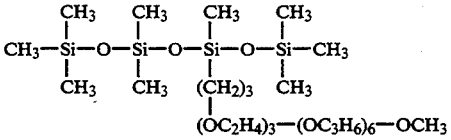

SU-I-16

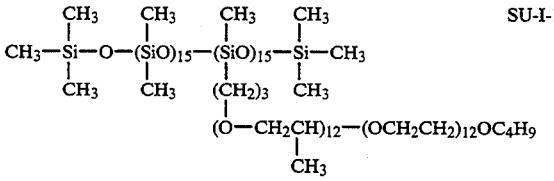

SU-I-17

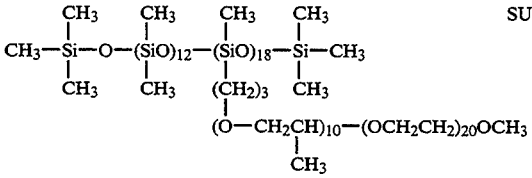

SU-I-18

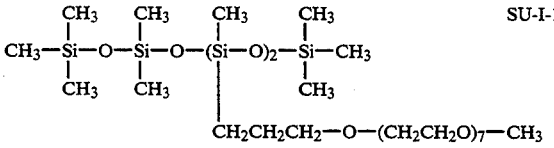

SU-I-19

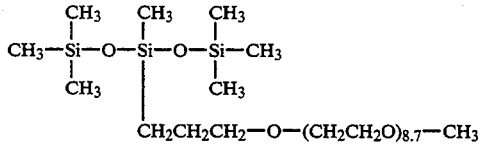

SU-I-20

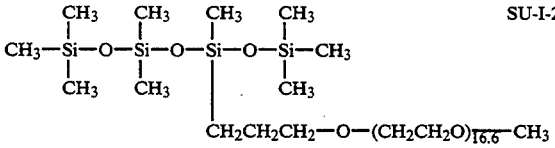

SU-I-21

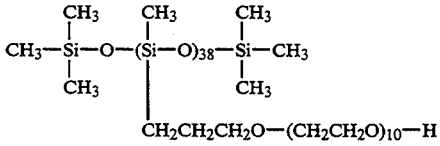

SU-I-22

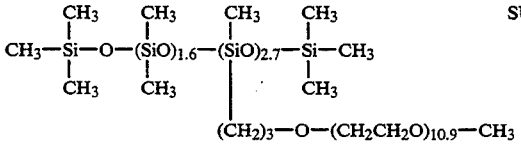

SU-I-23

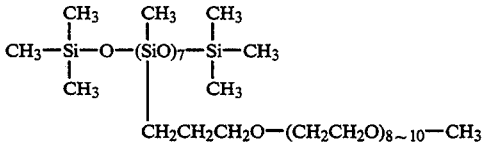

When the compounds exemplified on pages 37–39 of Japanese Pat. Appl. No. 89686/1991 (these are Compounds SU-I-1 through SU-I-23 reproduced above), water soluble organic siloxane compounds having a polyoxyalkylene group, are added in an amount of 0.01 to 20 g per liter of stabilizer, favorable results are obtained, particularly formation of precipitates and yellow stains can be effectively prevented.

An addition amount not more than 0.01 g/l causes stains on a light-sensitive material; an addition amount not less than 20 g/l allows the organic siloxane compound to deposit on a light-sensitive material in large amounts and thereby accelerates formation of stains.

The water soluble organic siloxane compound of the invention means such generally known water soluble organic siloxane compounds as are described, for example, in 18333/1972, 62128/1974, Japanese Pat. Exam. Pub. Nos. 51172/1980, 37538/1976 and U.S. Pat. No. 3,545,970.
The following are examples from JP51172/1980 and JP 37538/1976:
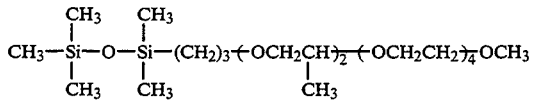
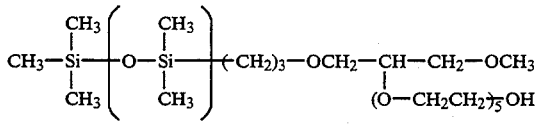
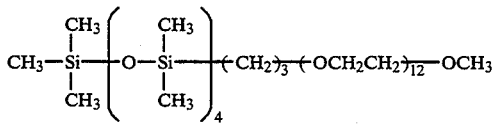
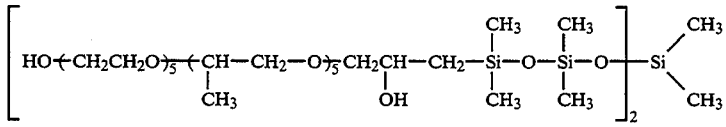
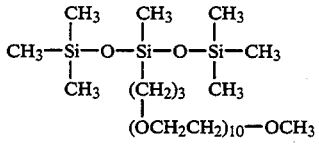
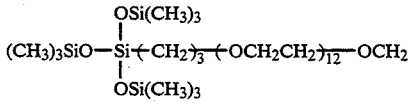
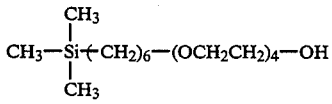
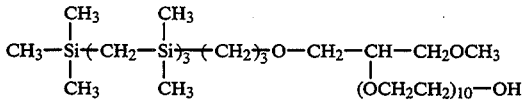
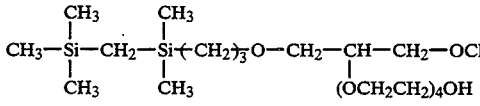
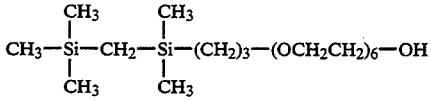
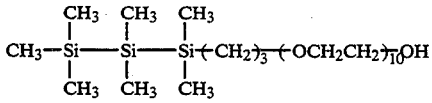
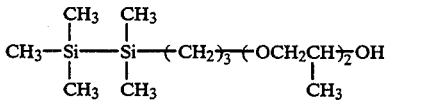

-continued
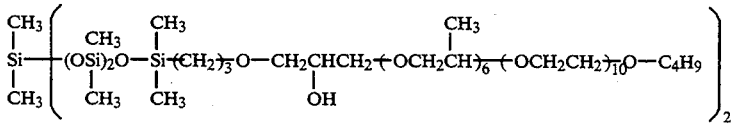
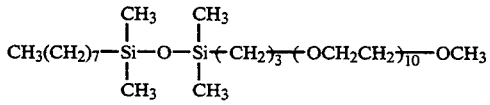
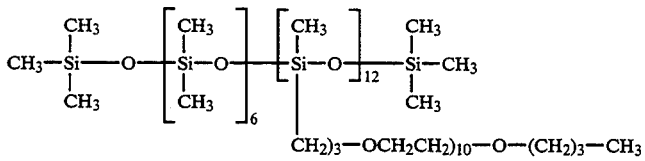
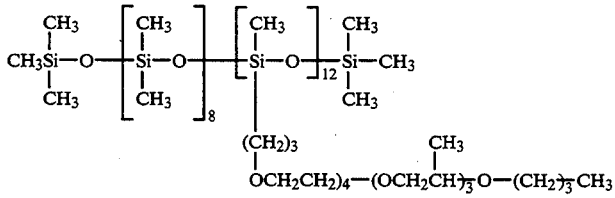
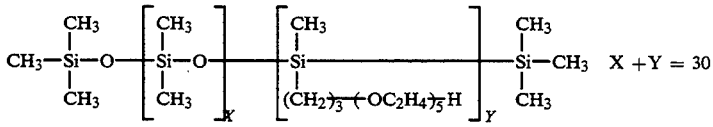
X + Y = 30
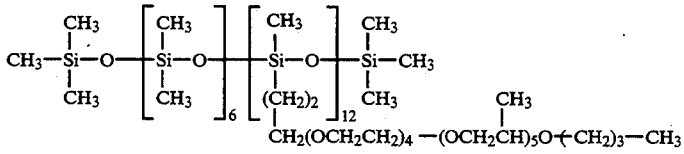
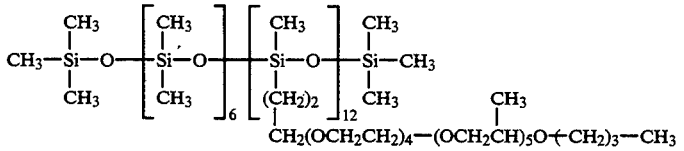
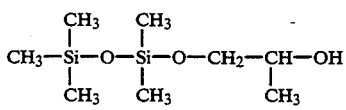
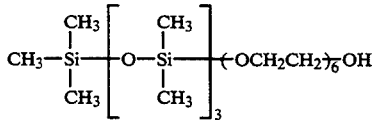
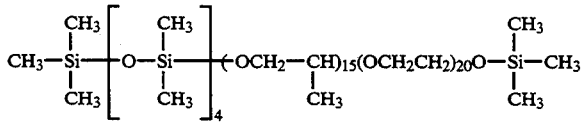
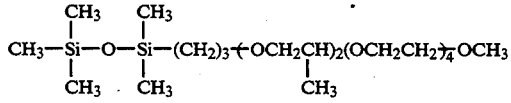

-continued
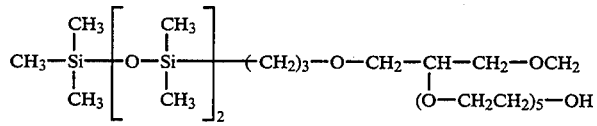
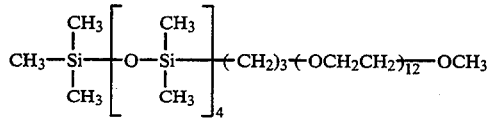
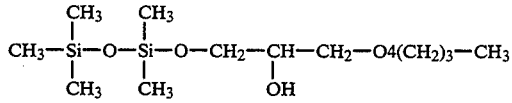
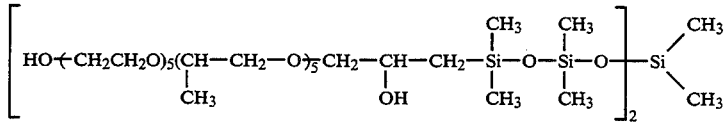
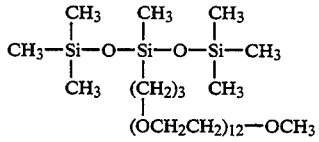
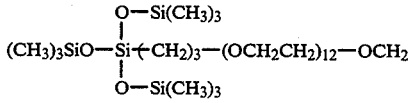
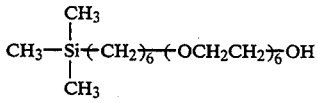
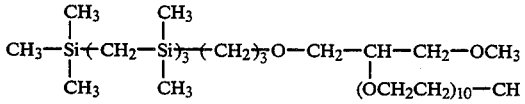
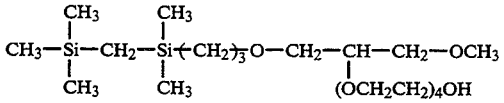
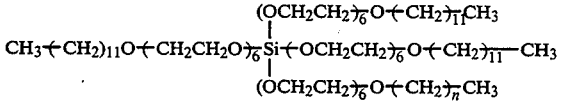
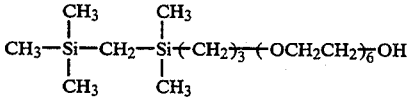
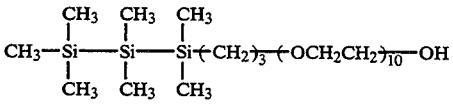
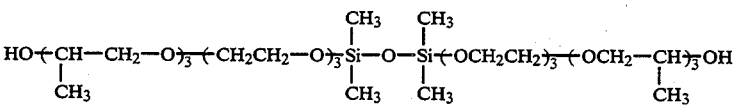

-continued

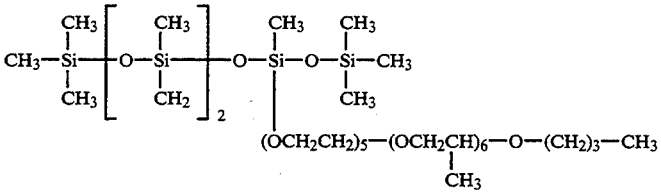

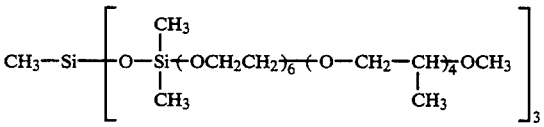

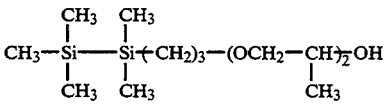

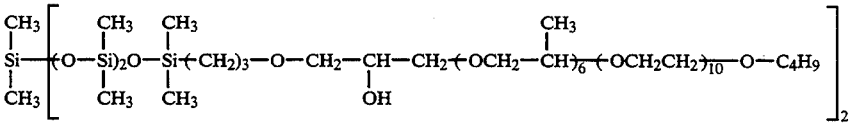

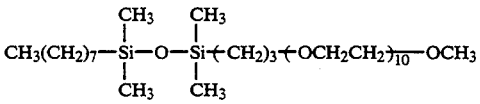

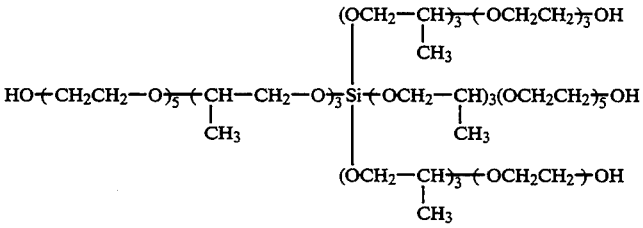

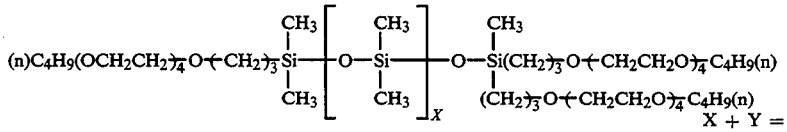

X + Y = 30

These water soluble organic siloxane compounds are commercially available from Union Carbide Corp., Shin-Etsu Chemical Co., etc.

In the invention, the wording "substantially no formaldehyde is contained in a stabilizer" means that the amount of formaldehyde present is within a range from 0 to 0.2 g per liter of stabilizer.

In the invention, the amount of the stabilizer replenished is desirably not more than 800 ml per square meter of light-sensitive material. But, too small a replenishing amount causes fading of dyes and deposition of salts on a dried light-sensitive material; therefore, the amount is more desirably in a range from 100 to 620 ml/l . Further, the replenishing amount varies with the configuration of a stabilizing bath and can be decreased as the number of tanks increases.

The pH of the stabilizer of the invention is desirably within a range from 2 to 12, more desirably from 4 to 11 and most desirably from 5 to 10 for bringing out the effect of the invention satisfactorily. The temperature of the stabilizer is preferably 15° to 70° C., especially 20° to 55° C. Further, the processing time with the stabilizer is desirably not more than 120 seconds, more desirably 3 to 90 seconds and most desirably 6 to 60 seconds.

When two or more stabilizer tanks are employed in practicing the invention, it is preferable that these tanks be arranged in a countercurrent mode (a replenisher is fed to the rear bath and an overflow is poured into the preceding bath) in order to bring out the effect of the invention, particularly to minimize the pollution load and improve image preservability.

In the invention, it is preferable that the stabilizer contain a chelating agent having a chelate stability constant not less than 8 against iron ions. "Chelate stability constant" used here means a constant generally known by L. G. Sillen and A. E. Martell, "Stability Constant of Metal-ion Complexes", The Chemical Society, London (1964) and S. Chaberek and A. E. Martell, "Organic Sequestering Agents", John Wiley & Sons (1959), etc.

Typical examples of chelating agents having a chelate stability constant not less than 8 against ferric ions include those described in Japanese Pat. Appl. Nos. 234776/1990 and 324507/1989.

These chelating agents are used in an amount of preferably 0.01 to 50 g per liter of stabilizer; especially, an addition amount of 0.05 to 20 g per liter produces much better results.

An ammonium compound is preferably added to the stabilizer in the form of ammonium salts of inorganic compounds; the addition amount thereof is preferably 0.001 to 1.0 mole, especially 0.002 to 2.0 moles per liter of stabilizer.

Further, it is preferable that a metal salt be jointly used with the above chelating agent in the stabilizer. Examples of such a metal salt include salts of Ba, Ca, Ce, Co, In, La, Mn, Ni, Bi, Pb, Sn, Zn, Ti, Zr, Mg, Al and Sr. And these are supplied in the form of inorganic salts or water soluble chelating agents such as halides, hydroxides, sulfates, carbonates, phosphates and acetates. The addition amount thereof is preferably $1\times10^{-4}$ to $1\times10^{-1}$ mole, especially $4\times10^{-4}$ to $2\times10^{-1}$ mole per liter of stabilizer.

Moreover, there may be added to the stabilizer an organic acid such as citric acid, acetic acid, succinic acid, oxalic acid or benzoic acid and a pH adjuster such as phosphates, borates, hydrochlorides or sulfates. These compounds are employed in an amount necessary to maintain the pH of the stabilizer and may be arbitrarily combined with one another within the limits not to exert harmful influences upon aging stability of photographic color images and formation of precipitates.

In the invention, it is preferable that the stabilizer contain fungicides. As such fungicides, combination of the compounds respectively represented by the following Formulas (B-1) to (B-3) brings out the effect of the invention much better.

Formula (B-1)

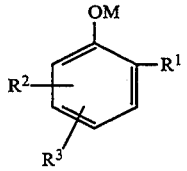

In the formula, $R^1$ represents an alkyl group, a cycloalkyl group, an aryl group, a hydroxy group, an alkoxy group, an amino group, a carboxyl group (including a salt thereof) or a sulfo group (including a salt thereof); $R^2$ and $R^3$ each represent a hydrogen atom, a halogen atom, an amino group, a nitro group, a hydroxyl group, an alkoxycarbonyl group, a carboxyl group (including a salt thereof) or sulfo group (including a salt thereof); M represents a hydrogen atom, an alkali metal or an ammonium group.

Formula (B-2)

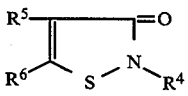

Formula (B-3)

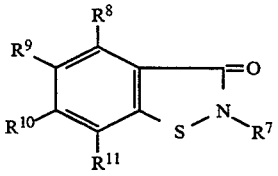

In the formulas, $R^4$ represents an hydrogen atom, an alkyl group, an aryl group, a halogenated alkyl group, $—R^{12}—OR^{13}$, $—CONHR^{14}$ (where $R^{12}$ is an alkylene group, $R^{13}$ and $R^{14}$ each are a hydrogen atom, an alkyl group or an aralkyl group) or an aralkyl group; $R^5$ and $R^6$ each represent a hydrogen atom, a halogen atom, a halogenated alkyl group or an alkyl group; $R^7$ represents a hydrogen atom, a halogen atom, an alkyl group, an aryl group, a halogenated alkyl group, an aryl group, $—R^{15}—OR^{16}$ or $—CONHR^{17}$ (where $R^{15}$ is an alkylene group, $R^{16}$ and $R^{17}$ each are a hydrogen atom or an alkyl group); $R^8$, $R^9$, $R^{10}$ and $R^{11}$ each represent a hydrogen atom a halogen atom, a hydroxyl group, an alkyl group, an amino group or a nitro group.

Next, the compounds respectively represented by Formulas (B-1) to (B-3) are described. Typical examples of the compounds represented by Formula (B-1) are as follows:

(B-1-1)

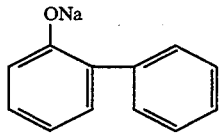

(B-1-2)

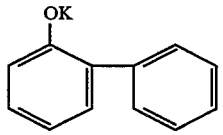

(B-1-3)

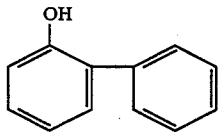

(B-1-4)

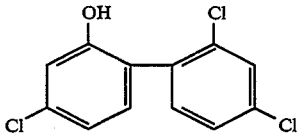

(B-1-5)

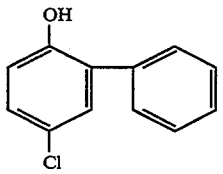

(B-1-6)

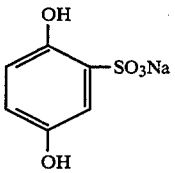

(B-1-7)

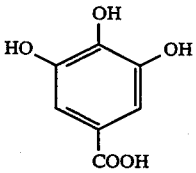

(B-1-8)

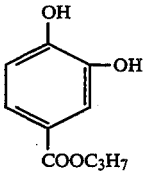

-continued (B-1-9)

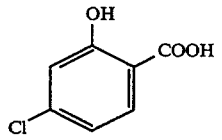

(B-1-10)

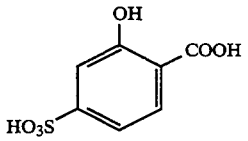

(B-1-11)

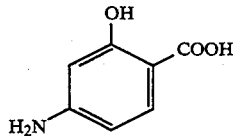

(B-1-12)

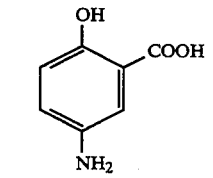

(B-1-13)

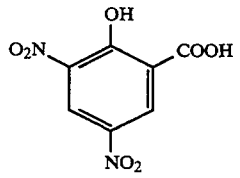

(B-1-14)

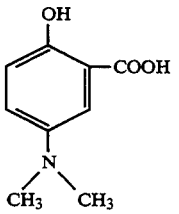

(B-1-15)

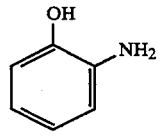

(B-1-16)

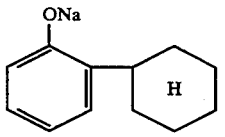

(B-1-17)

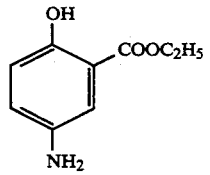

(B-1-18)

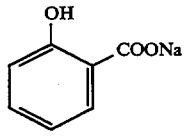

-continued (B-1-19)

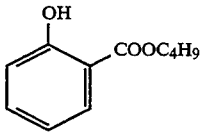

Compounds (B-I-11) to (B-I-19) exemplified on page 45 of Japanese Pat. Appl. No. 89686/1991.

Some of the compounds represented by Formula (B-1) are known as antiseptics for tangerines and can be readily procured in the market. Among the above exemplified compounds, (B-1-1), (B-1-2) , (B-1-3), (B-1-4) and (B-1-5) are preferred.

The compounds of Formula (B-1) usable in the invention are employed in an amount of desirably 0.03 to 50 g, more desirably 0.12 to 10 g, and most desirably 0.15 to 5 g per liter of stabilizer of the invention.

Typical examples of the compounds represented by Formula (B-2) or (B-3) are shown below.

(B-2-1) 2-Methyl-4-isothiazoline-3-one
(B-2-2) 5-Chloro-2-methyl-4-isothiazoline-3-one
(B-2-3) 2-Methyl-5-phenyl-4-isothiazoline-3-one
(B-2-4) 4-Bromo-5-chloro-2-methyl-4-isothiazoline-3-one
(B-2-5) 2-hydroxymethyl-4-isothiazoline-3-one
(B-2-6) 2-(2-ethoxyethyl)-4-isothiazoline-3-one
(B-2-7) 2-(N-methyl-carbamoyl)-4-isothiazoline-3-one
(B-2-8) 5-Bromomethyl-2-(N-dichlorophenyl-carbamoyl)-4-isothiazoline-3-one
(B-2-9) 5-Chloro-2-(2-phenylethyl)-4-isothiazoline-3-one
(B-2-10) 4-Methyl-2-(3,4-dichlorophenyl)-4-isothiazoline-3-one
(B-3-1) 1,2-benzisothiazoline-3-one
(B-3-2) 2-(2 -bromoethyl )-1,2-benzisothiazoline-3-one
(B-3-3) 2-Methyl-1,2-benzisothiazoline-3-one
(B-3-4) 2-Ethyl-5-nitro-1,2-benzisothiazoline-3-one
(B-3-5) 2-Benzyl-1,2-benzisothiazoline-3-one
(B-3-6) 5-Chloro-1,2-benzisothiazoline-3-one Syntheses of these exemplified compounds and application of them to other fields are described in U.S. Pat. Nos . 2,767,172, 2,767,173, 2,767,174, 2,870,015, British Pat. No. 848,130 and French Pat. No. 1,555,416. Some of them are commercially available under the trade names of Topcide 300, Topcide 600 (PERMACHEM. Asia Co.), Finecide J-700 (Tokyo Fine Chemicals Co.) and Proxel GXL (I.C.I. Ltd.).

These compounds of Formula (B-2) or (B-3) are used in an amount of preferably 0.001 to 20 g, especially 0.005 to 5 g per liter of stabilizer of the invention.

In the processing according to the invention, silver may be recovered. For example, there may be effectively employed the electrolysis method (disclosed in French Pat. No. 2,299,667), the precipitation method disclosed in Japanese Pat. O.P.I. Pub. No. 73037/1977, German Pat. No. 2,331,220), the ion exchange method (disclosed in Japanese Pat. O.P.I. Pub. No. 17114/1976, German Pat. No. 2,548,237) and the metal replacement method (disclosed in British Pat. No. 1,353,805). To improve the rapid processability, an in-line silver recovery from a tank solution by means of electrolysis or an anion exchange resin is particularly preferred, but the recovery may also be carried out from a waste overflow.

In addition, the stabilizer may be subjected to ion exchange, electrodialysis (see Japanese Pat. O.P.I. Pub.

No. 28949/1986) or reverse osmosis (see Japanese Pat. O.P.I. Pub. Nos. 240153/1985, 254151/1987). It is also preferable that the water used in the stabilizer be deionized in advance. These means help to increase the antimold capability, stability of the stabilizer and the aging stability of dye images. Such a deionization treatment can be carried out by any means as long as it can reduce Ca and Mg ion content of a treated water to 5 ppm or less, but preferably, a treatment with an ion exchange resin or that with a reverse osmosis membrane is carried out singly or in combination. The deionization with an ion exchange resin and that with a reverse osmosis membrane are described in detail in KOKAI GIHO (Voluntary Technical Publication) Nos. 87-1987 and 89-20511.

After the stabilizing process, no washing process is required at all, but a short-time rinsing or a surface washing with a small amount of water may be carried out according to a specific requirement.

Color developing agents usable in the color developing process include aminophenol compounds and p-phenylenediamine compounds, and p-phenylenediamine compounds having a water-solubilizing group are preferred in the invention. Such water-solubilizing groups serve enough so long as at least one of them is present on the amino group or the benzene nucleus of the p-phenylenediamine compound.

Typical examples of the water-solubilizing group include $-(CH_2)_n-CH_2OH$, $-(CH_2)_m-NH-SO_2-(CH_2)_n-CH_3$, $-(CH_2)_mO-(CH_2)_n-CH_3$, $-(CH_2CH_2O)_nC_mH_{2m+1}$ (m and n each indicate an integer of 0 or more), —COOH and $-SO_3H$. Typical examples of the color developing agents preferably used in the invention include those exemplified in Japanese Pat. Appl. Nos. 324507/1989 and 234776/1990.

The addition amount of the color developing agent is desirably not less than $0.5\times10^{-2}$ mole, more desirably $1.0\times10^{-2}$ to $1.0\times10^{-1}$ mole, and most desirably $1.5\times10^{-2}$ to $7.0\times10^{-1}$ per liter of color developer.

The color developer used in the color developing process may contain compounds employed in a conventional developer.

The pH of the color developer is usually not less than 7, preferably about 9 to 13.

In continuous processing of photographing color light-sensitive materials, the replenishing amount of the color developer is desirably not more than 1.5 1, more desirably 250 to 900 ml, and most desirably 300 to 700 ml per square meter of light-sensitive material.

As bleaching agents used in a bleacher or a bleach-fixer according to the invention, ferric complex salts of the organic acids represented by the following Formula (A) or (B) are preferred.

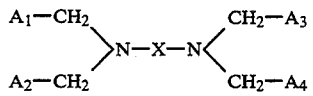

Formula (A)

In the formula, $A_1$ to $A_4$ may be the same or different and each represent $-CH_2OH$, —COOM or $-PO_3M_1M_2$, where M, $M_1$ and $M_2$ each represent a hydrogen atom, an alkali metal atom (e.g., sodium, potassium) or an ammonium group; X represents a substituted or unsubstituted alkylene group having 3 to 6 carbon atoms (e.g., propylene, butylene, pentamethylene); and the substituent is a hydroxyl group or an alkyl group having 1 to 3 carbon atoms.

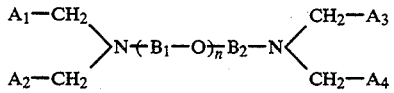

Formula (B)

In the formula, $A_1$ to $A_4$ are the same as the above; n represents an integer of 1 to 8; $B_1$ and $B_2$ may be the same or different and each represent a substituted or unsubstituted alkylene group having 2 to 5 carbon atoms (e.g., ethylene, propylene, butylene, pentamethylene); and the substituent is a hydroxyl group or a lower alkyl group having 1 to 3 carbon atoms (e.g., methyl, ethyl, propyl).

The following are typical examples of the compound represented by Formula (A) or (B) :

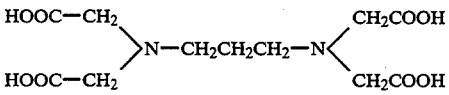

(A-1)

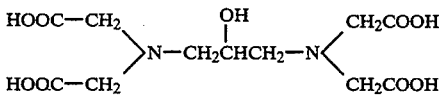

(A-2)

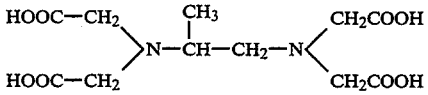

(A-3)

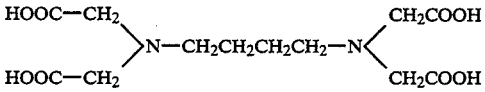

(A-4)

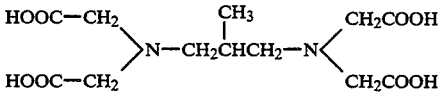

(A-5)

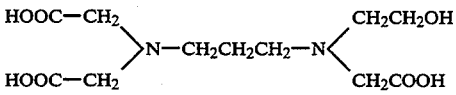

(A-6)

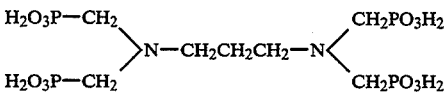

(A-7)

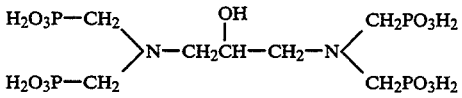

(A-8)

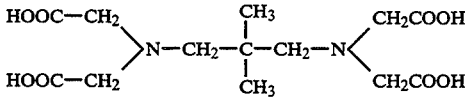

(A-9)

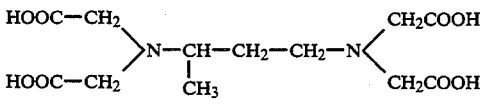

(A-10)

-continued (A-11)

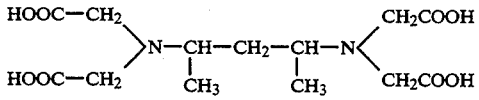

(A-12)

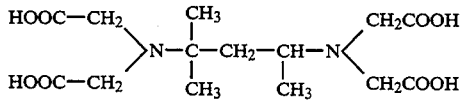

(B-1)

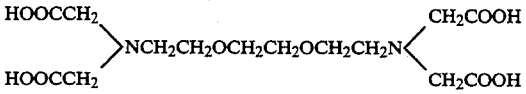

(B-2)

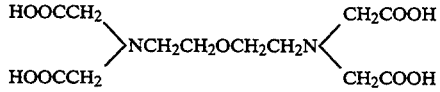

(B-3)

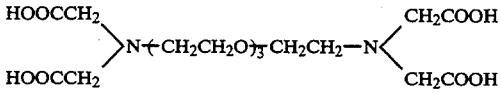

(B-4)

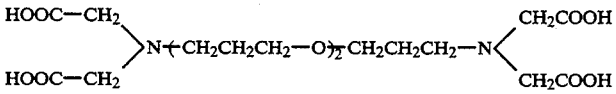

(B-5)

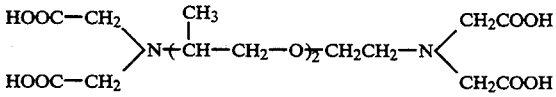

(B-6)

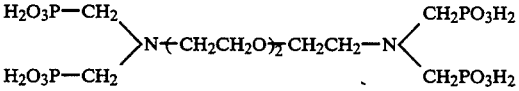

(B-7)

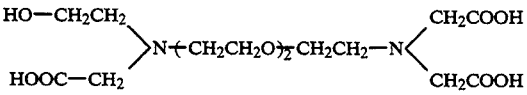

As ferric complex salts of these compounds (A-1) to (A-12) and (B-1) to (B-7), there may be arbitrarily used sodium salts, potassium salts or ammonium salts of ferric complexes of them.

Among the above compounds, (A-1), (A-3), (A-4), (A-5), (A-9), (A-10), (A-11), (B-1), (B-2) and (B-7) are preferred in the invention; (A-1) and (B-1) are particularly preferred.

These organic acid ferric complex salts are used in an amount of preferably 0.1 to 2.0 moles, especially 0.15 to 1.5 moles per liter of bleacher.

Besides the above ferric complex salts of the compounds represented by Formula (A) or (B), there may also be used as bleaching agents the compounds exemplified on pages 79–80 of Japanese Pat. Appl. No. 302784/1990.

When two or more of these organic acid ferric complex salts are used in combination, the ferric complex salts of the compounds represented by Formula (A) or (B) amounts to desirably 70% (in molar equivalent) or above, more desirably 80% or above, most desirably 90% or above and especially 95% or above in order to bring out the effect of the invention much more.

The rapid processability of the bleacher, bleach-fixer and stabilizer can be enhanced by adding thereto at least one compound selected from imidazole and its derivatives described in Japanese Pat. O.P.I. Pub. No. 295258/1989, the compounds represented by one of Formulas (I) to (IX) defined in the same Japanese patent publication and the exemplified compounds thereof.

In addition to the above accelerators, there may also be used the compounds exemplified on pages 51–115 of Japanese Pat. O.P.I. Pub. No. 123459/1987, the compounds exemplified on pages 22–25 of Japanese Pat. O.P.I. Pub. No. 17445/1988 and the compounds described in Japanese Pat. O.P.I. Pub. Nos. 95630/1988, 28426/1988.

These accelerators may be used singly or in combination, the addition amount is desirably 0.01 to 100 g, more desirably 0.05 to 50 g, and most desirably 0.05 to 15 g per liter of bleacher. The temperature of the bleacher or bleach-fixer is usually 20° to 50° C., preferably 25° to 45° C. The pH of the bleacher is preferably not more than 6.0, especially 1.0 to 5.5. The pH of the bleach-fixer is preferably 5.0 to 9.0, especially 6.0 to 8.5. The pH of the bleacher and that of the bleach-fixer defined here are pHs of respective processing baths in processing silver halide light-sensitive materials and clearly distinguished from the pH of a replenisher.

The bleacher or the bleach-fixer may contain other known photographic compounds.

The replenishing amount of the bleacher or the bleach-fixer is desirably not more than 500 ml, more desirably 20 to 400 ml, and most desirably 40 to 350 ml per square meter of silver halide light-sensitive material. The effect of the invention can be achieved more obviously as the replenishing amount decreases.

In the invention, air or oxygen may be blown into a processing bath and a replenisher storage tank if desired, or a suitable oxidizing agent such as hydrogen peroxide, a bromate or a persulfate may be added, in order to raise the activity of the bleacher or the bleach-fixer.

As fixing agents, conventional ones can be used in the fixer or the bleach-fixer, but preferred fixing agents are thiocyanates and thiosulfates.

The content of thiocyanates is preferably not less than 0.1 mol/l. When these are used in processing color negative films, the content is preferably not less than 0.3 mol/l, especially not less than 0.5 mol/l. Thiosulfates are used in an amount of preferably not less than 0.2 mol/l. In the case of processing color negative films, the content is preferably not less than 0.5 mol/l. Besides these fixing agents, conventional pH buffers may be employed singly or in combination in the fixer or the bleach-fixer.

In addition, it is preferable that an alkali halide or an ammonium halide, such as potassium bromide, sodium bromide, sodium chloride or ammonium bromide, be contained in a large amount as a rehalogenating agent. Further, there may also be added those compounds which are known as additives for a fixer or a bleach-fixer, such as alkylamines and polyethylene oxides.

Further, silver may be recovered from the fixer or the bleach-fixer according to a conventional method.

The replenishing amount of the fixer is usually 50 to 900 ml, preferably 100 to 500 ml per square meter of light-sensitive material.

The pH of the fixer is preferably 4 to 8.

It is preferable that a processing solution having a fixing capability contain the compound represented by the following Formula (FA) defined on page 56 of Japanese Pat. O.P.I. Pub. No. 295258/1989 or an exemplified compound thereof. This helps to bring out the effect of the invention much satisfactorily and to minimize formation of sludges in a processing solution having a fixing capability when small amounts of light-sensitive materials are processed over a long time.

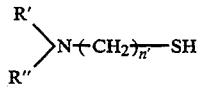

Formula (FA)

The compounds expressed by Formula (FA) defined in the above patent publication can be synthesized by general methods described, for example, in U.S. Pat. Nos. 3,335,161 and 3,260,718. These compounds may be used singly or in combination of two or more.

The compounds of Formula (FA) produce good results when used in an amount of 0.1 to 200 g per liter of processing solution.

In the invention, the processing time with the bleacher and that with the fixer may be arbitrarily selected, but these are desirably not longer than 3 min and 30 sec, more desirably 10 sec to 2 min and 20 sec and most desirably 20 sec to 1 min and 20 sec, respectively. The processing time with the bleach-fixer is desirably not longer than 4 min, more desirably 10 sec to 2 min and 20 Sec.

In the processing method according to the invention, it is preferable that the bleacher, the bleach-fixer or the fixer be subjected to forced stirring for the purpose of bringing out the effect of the invention noticeably and enhancing the rapid processability. "Forced stirring"0 means that the stirring is forcedly carried out by use of a stirring means, unlike the move of a solution due to diffusion. As means for such forced stirring, there can be used stirring means disclosed in Japanese Pat. O.P.I. Pub. Nos. 222259/1989 and 206343/1989.

In the invention, when the crossover time from a color developing bath to a bleaching bath or a bleach-fixing bath is kept within 10 seconds, preferably within 7 seconds, bleach fogs can be prevented as another effect of the invention.

Besides the above compounds contained in processing solutions used in the processing method of the invention, these processing solutions may contain the following additives.

The bleacher may contain conventional additives such as bleaching agents, pH regulators, acids and the addition amount of the acids and bleach accelerators described on pages 3–4 of Japanese Pat. O.P.I. Pub. No. 44347/1990 and on pages 37–38 of Japanese Pat. O.P.I. Pub. No. 43546/1990. The fixer may use conventional additives such as fixing agents, fixing accelerators, preservatives and chelating agents described on page 4 of Japanese Pat. O.P.I. Pub. No. 44347/1990. The bleach-fixing may use those described on pages 37–38 of Japanese Pat. O.P.I. Pub. No. 43546/1990. The stabilizer of the invention may employ bactricides, antimolds, chalating agents and optical whitening agents described on pages 38–39 of Japanese Pat. O.P.I. Pub. No. 43546/1990.

In silver halide color photographic light-sensitive materials used in the invention, there can be used silver halide emulsions described in Research Disclosure No. 308119 (hereinafter abbreviated to RD308119). The locations of the relevant descriptions are as follows:

| [Item] | | [Page of RD308119] |
|---|---|---|
| Iodide composition | | 993 I Sec. A |
| Preparation process | | 933 I Sec. A and 994 Sec. E |
| Crystal habit | Regular crystal | 993 I Sec. A |
| | Twin crystal | 993 I Sec. A |
| Epitaxial | | 993 I Sec. A |
| Halogen composition | Uniform | 993 I Sec. B |
| | Not uniform | 993 I Sec. B |
| Halogen conversion | | 994 I Sec. C |
| Halogen replacement | | 994 I Sec. C |
| Metals contained | | 994 I Sec. D |
| Monodispersion | | 995 I Sec. F |
| Solvent addition | | 995 I Sec. F |
| Latent image forming position | Surface | 995 I Sec. G |
| | Inside | 995 I Sec. G |
| Light-sensitive material | Negative | 995 I Sec. H |
| | Positive | 995 I Sec. H |
| (containing internally fogged grains) | | |
| Use of emulsions as a mixture | | 995 I Sec. J |
| Desalting | | 995 II Sec. A |

In the invention, silver halide emulsions are subjected to physical ripening, chemical ripening and spectral sensitization before use. Additives used in such processes are described in Research Disclosure Nos. 17643, 18716 and 308119 (hereinafter abbreviated to RD17643, RD18716 and RD308119, respectively).

The locations of the relevant descriptions are as follows:

| [Item] | [Page of RD308119] | [RD17643] | [RD18716] |
|---|---|---|---|
| Chemical sensitizer | 996 III Sec. A | 23 | 648 |
| Spectral sensitizer | 996 IV Sec. A-A, B, C, D, E, H, I, J | 23–24 | 648–9 |
| Supersensitizer | 996 IV Sec. A–E, J | 23–24 | 648–9 |
| Antifoggant | 998 VI | 24–25 | 649 |
| Stabilizer | 998 VI | 24–25 | 649 |

The above numbers of Research Disclosure also describe conventional photographic additives usable in the invention. The following list shows the locations of the relevant descriptions.

| [Item] | [Page of RD308119] | [RD17643] | [RD18716] |
|---|---|---|---|
| Anti-color-mixing agent | 1002 VII Sec. I | 25 | 650 |
| Dye image stabilizer | 1001 VII Sec. J | 25 | |
| Whitening agent | 998 V | 24 | |
| UV absorbent | 1003 VIII Sec. C | 25–26 | |

-continued

| [Item] | [Page of RD308119] | [RD17643] | [RD18716] |
|---|---|---|---|
| | XIII Sec. C | | |
| Light absorbent | 1003 VIII | 25–26 | |
| Light scattering agent | 1003 VIII | | |
| Filter dye | 1003 VIII | 25–26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, coating aid | 1005 XI | 26–27 | 650 |
| Matting agent | 1007 XVI | | |
| Developer (contained in light-sensitive material) | 1011 XX Sec. B | | |

Various couplers can be employed in light-sensitive materials used in the invention, typical examples of such couplers are also described in the above numbers of Research Disclosure. The locations of the relevant descriptions are as follows:

| [Item] | [Page of RD308119] | [RD17643] | [RD18716] |
|---|---|---|---|
| Yellow coupler | 1001 VII Sec. D | VII | Sec. C–G |
| Magenta coupler | 1001 VII Sec. D | VII | Sec. C–G |
| Cyan coupler | 1001 VII Sec. D | VII | Sec. C–G |
| Colored coupler | 1002 VII Sec. G | VII | Sec. G |
| DIR coupler | 1001 VII Sec. F | VII | Sec. F |
| BAR coupler | 1002 VII Sec. F | | |
| Other useful group releasing coupler | 1001 VII Sec. F | | |
| Alkali-soluble coupler | 1001 VII Sec. E | | |

The additives used in the invention can be added by the dispersing method or the like described in XIV of RD308119.

In the invention, there may be used the supports described on page 28 of RD17643, pages 647–8 of RD18716 and in XVII of RD308119.

In the light-sensitive material used in the invention, there may be provided auxiliary layers such as a filter layer and an intermediate layer described in Section K of VII in RD308119. Further, these light-sensitive materials may have various layer configurations, such as conventional layer order, inverted layer order and unit layer structure described in Section K of VII in RD308119.

The effect of the invention can be brought out much better by incorporating at least one compound selected from those represented by Formula (B-1), (B-2) or (B-3) in light-sensitive materials.

The present invention can be applied to color photographic light-sensitive materials such as color papers for popular use or for movie, color negative films, color reversal films, color reversal papers, direct positive color papers, color films for movie and color films for TV, but it can be applied most advantageously to color photographic light-sensitive materials for transmission.

EXAMPLES

The present invention is hereunder described in detail with examples.

Example 1

The following stabilizer was prepared.

| | |
|---|---|
| 1,2-Benzisothiazoline-3-one | 0.05 g |
| Surfactant (exemplified compound SII-5) | 0.5 g |
| A compound of Formula (I) or a comparative compound (see Tables 4 and 5) | 2.5 g |
| A compound of Formula (II) or a comparative compound (see Tables 4 and 5) | 8.0 g |
| Fixer (*1) | 100 ml |

Water was added to make 1 liter, and the pH was adjusted to 8.5.

After the pH adjustment, 1 liter of this stabilizer was kept at 30° C. in a beaker having a 20-$cm^2$ opening to count the number of days till sulfur or sulfides began to precipitate. Separately, 1 liter of the stabilizer was kept at 5° C. for 1 week in a polyvinyl chloride container having a 10-$cm^2$ opening to observe if precipitates would be formed. The evaluation results are summarized in Tables 4 and 5, where formation of precipitates is shown by C, slight formation by B and no precipitation by A. (*1) The composition of the fixer was as follows:

| | |
|---|---|
| Ammonium thiosulfate | 180 g |
| Ammonium sulfite | 15 g |
| Silver bromide | 0.5 g |

Water was added to make 1 liter, then the pH was adjusted to 7.0 with ammonium hydroxide or glacial acetic acid.

TABLE 4

| Compound of Formula (I) or Comparative Compound | Compound of Formula (II) or Comparative Compound | Solution Preservability number of days till precipitates were formed | Low Temperature Storage formation of precipitates |
|---|---|---|---|
| — | — | 12 days | B |
| Formaldehyde 4.0 ml | — | 1 day | B |
| Formaldehyde 4.0 ml | II-18 | 1 day | B |
| Formaldehyde 4.0 ml | Triethanolamine | 3 days | B |
| Dimethylolurea 3.0 g | — | 2 days | C |
| Dimethylolurea 3.0 g | II-18 | 3 days | B |
| Illustrated compound (2) | — | 9 days | B |
| Illustrated compound (2) | Triethanolamine | 10 days | B |
| Illustrated compound (2) | II-18 | 14 days | A |
| Illustrated compound (2) | II-19 | 15 days | A |
| Illustrated compound (2) | II-20 | 15 days | A |
| Illustrated compound (2) | II-23 | 14 days | A |
| Illustrated compound (2) | II-24 | 12 days | A |
| Illustrated compound (2) | II-40 | 14 days | A |
| Illustrated compound (3) | — | 10 days | B |
| Illustrated compound (3) | Triethanolamine | 11 days | B |
| Illustrated compound (3) | II-18 | 15 days | A |
| Illustrated compound (3) | II-19 | 17 days | A |
| Illustrated compound (3) | II-20 | 15 days | A |
| Illustrated | II-23 | 15 days | A |

TABLE 4-continued

| Compound of Formula (I) or Comparative Compound | Compound of Formula (II) or Comparative Compound | Solution Preservability number of days till precipitates were formed | Low Temperature Storage formation of precipitates |
|---|---|---|---|
| compound (3) | | | |

TABLE 5

| Compound of Formula (I) or Comparative Compound | Compound of Formula (II) | Solution Preservability number of days till precipitates were formed | Low Temperature Storage formation of precipitates |
|---|---|---|---|
| Illustrated compound (3) | II-22 | 14 days | A |
| Illustrated compound (3) | II-24 | 15 days | A |
| Illustrated compound (3) | II-40 | 13 days | A |
| Illustrated compound (3) | II-47 | 13 days | A |
| Illustrated compound (3) | II-2 | 11 days | A |
| Illustrated compound (3) | II-3 | 12 days | A |
| Illustrated compound (3) | II-5 | 14 days | A |
| Illustrated compound (3) | II-6 | 14 days | A |
| Illustrated compound (4) | — | 8 days | B |
| Illustrated compound (4) | II-18 | 13 days | A |
| Illustrated compound (4) | II-18 | 13 days | A |
| Illustrated compound (6) | — | 8 days | B |
| Illustrated compound (6) | II-18 | 12 days | A |
| Illustrated compound (21) | II-18 | 12 days | A |
| Illustrated compound (49) | II-18 | 12 days | A |
| Illustrated compound (58) | II-18 | 12 days | A |

As shown in Tables 4 and 5, there were observed poor solution preservabilities and formation of precipitates in low temperature storing with the stabilizers containing formaldehyde and the stabilizers containing a conventional substitute for formaldehyde. On the contrary, the stabilizers containing a compound of Formula (II) and a compound of Formula (I) exhibited good results in solution preservability and low temperature storage.

Example 2

The following stabilizer concentrated solution was prepared.

| | |
|---|---|
| 1,2-Benzisothiazoline-3-one | 0.05 g |
| Surfactant (exemplified compound SII-5) | 0.5 g |
| A compound of Formula (I) or a comparative compound (see Table 6) | 2.5 g |
| A compound of Formula (II) or a comparative compound (see Table 6) | 8.0 g |

The pH was adjusted to 9.5 with 40% aqueous KOH.

After the adjustment, the concentrated solution was kept at 5° C. for 1 week in a sealed screw tube to observe if precipitates would appear. Separately, the concentrated solution was kept at 50° C. for 2 weeks in a sealed screw tube, then the residual amount of a compound expressed by Formula (I) or that of a comparative compound was determined. Determination of the compound of Formula (I) or the comparative compound was performed by the 2,4-dinitrophenylhydrazine method described in "Determination and Assessment of Environmentally Harmful Objects" published by Labor Science Institute.

TABLE 6

| Compound of Formula (I) or Comparative Compound | Compound of Formula (II) or Comparative Compound | Formation of Precipitates | Residual Amount of Compound of Formula (I) or Comparative Compound |
|---|---|---|---|
| Formaldehyde 4.0 ml | — | B | 80 |
| Formaldehyde 4.0 ml | Triethanol-amine | B | 80 |
| Illustrated compound (2) | — | C | 88 |
| Illustrated compound (2) | Triethanol-amine | C | 89 |
| Illustrated compound (2) | II-2 | A | 93 |
| Illustrated compound (2) | II-5 | A | 97 |
| Illustrated compound (2) | II-6 | A | 95 |
| Illustrated compound (2) | II-18 | A | 97 |
| Illustrated compound (2) | II-19 | A | 97 |
| Illustrated compound (2) | II-20 | A | 97 |
| Illustrated compound (2) | II-23 | A | 95 |
| Illustrated compound (2) | II-40 | A | 91 |
| Illustrated compound (3) | — | C | 89 |
| Illustrated compound (3) | Triethanol-amine | C | 89 |
| Illustrated compound (3) | II-2 | A | 98 |
| Illustrated compound (3) | II-3 | A | 97 |
| Illustrated compound (3) | II-6 | A | 97 |
| Illustrated compound (3) | II-18 | A | 95 |
| Illustrated compound (3) | II-19 | A | 95 |
| Illustrated compound (3) | II-20 | A | 96 |
| Illustrated compound (3) | II-23 | A | 95 |
| Illustrated compound (6) | — | C | 90 |
| Illustrated compound (6) | Triethanol-amine | C | 90 |
| Illustrated compound (6) | II-6 | A | 96 |
| Illustrated compound (6) | II-19 | A | 95 |
| Illustrated compound (6) | II-20 | A | 95 |
| Illustrated compound (21) | II-18 | A | 95 |
| Illustrated compound (49) | II-18 | A | 96 |
| Illustrated compound (58) | II-18 | A | 98 |

As seen in Table 6, precipitates were formed or the residual amount of the compound expressed by Formula (I) decreased in the stabilizer concentrated compositions containing formaldehyde or the stabilizer concentrated compositions containing a conventional substitute for formaldehyde. In the stabilizer concentrated compositions according to the invention, however, no precipitates were formed and the residual amount did not decrease so much.

Example 3

In this example, the amounts of compounds used in the silver halide photographic light-sensitive material are given in g/m$^2$ unless otherwise indicated. The amounts of silver halides and colloidal silvers are shown in amounts of silver present.

Sample 1 of multilayer color photographic light-sensitive material was prepared by forming the following layers in sequence on a triacetylcellulose film support.

1st layer: antihalation layer

| | |
|---|---|
| 1st layer: antihalation layer | |
| Black colloidal silver | 0.18 |
| UV absorbent (UV-1) | 0.20 |
| Colored coupler (CC-1) | 0.05 |
| Colored coupler (CM-2) | 0.06 |
| High boiling solvent (Oil-1) | 0.20 |
| Gelatin | 1.5 |
| 2nd layer: intermediate layer | |
| UV absorbent (UV-1) | 0.01 |
| High boiling solvent (Oil-1) | 0.01 |
| Gelatin | 1.2 |
| 3rd layer: low-speed red-sensitive emulsion layer | |
| Silver iodobromide emulsion (Em-1) | 0.9 |
| Silver iodobromide emulsion (Em-2) | 0.6 |
| Sensitizing dye (S-1) | $2.2 \times 10^{-4}$ (mol/mol Ag) |
| Sensitizing dye (S-2) | $2.5 \times 10^{-4}$ (mol/mol Ag) |
| Sensitizing dye (S-3) | $0.5 \times 10^{-4}$ (mol/mol Ag) |
| Cyan coupler (C-4') | 1.2 |
| Cyan coupler (C-2') | 0.3 |
| Colored cyan coupler (CC-1) | 0.05 |
| DIR compound (D-1) | 0.002 |
| High boiling solvent (Oil-1) | 0.5 |
| Gelatin | 1.2 |
| 4th layer: high-speed red-sensitive emulsion layer | |
| Silver iodobromide emulsion (Em-3) | 2.0 |
| Sensitizing dye (S-1) | $2.2 \times 10^{-4}$ (mol/mol Ag) |
| Sensitizing dye (S-2) | $2.0 \times 10^{-4}$ (mol/mol Ag) |
| Sensitizing dye (S-3) | $0.1 \times 10^{-4}$ (mol/mol Ag) |
| Cyan coupler (C-1') | 0.20 |
| Cyan coupler (C-2') | 0.03 |
| Cyan coupler (C-3') | 1.15 |
| Colored cyan coupler (CC-1) | 0.015 |
| DIR compound (D-2) | 0.05 |
| High boiling solvent (Oil-1) | 0.5 |
| Gelatin | 1.3 |
| 5th layer: intermediate layer | 0.5 |
| Gelatin | |
| 6th layer: low-speed green-sensitive emulsion layer | |
| Silver iodobromide emulsion (Em-1) | 1.1 |
| Sensitizing dye (S-4) | $5 \times 10^{-4}$ (mol/mol Ag) |
| Sensitizing dye (S-5) | $2 \times 10^{-4}$ (mol/mol Ag) |
| Magenta coupler (M-1) | 0.45 |
| Colored magenta coupler (CM-1) | 0.05 |
| DIR compound (D-3) | 0.015 |
| DIR compound (D-4) | 0.020 |
| High boiling solvent (Oil-2) | 0.5 |
| Gelatin | 1.0 |
| 7th layer: intermediate layer | |
| Gelatin | 0.9 |
| High boiling solvent (Oil-1) | 0.2 |
| 7th layer: high-speed green-sensitive emulsion layer | |
| Silver iodobromide emulsion (Em-3) | 1.2 |
| Sensitizing dye (S-6) | $1.5 \times 10^{-4}$ (mol/mol Ag) |
| Sensitizing dye (S-7) | $2.5 \times 10^{-4}$ (mol/mol Ag) |
| Sensitizing dye (S-8) | $0.7 \times 10^{-4}$ (mol/mol Ag) |
| Magenta coupler (M-2) | 0.08 |
| Magenta coupler (M-3) | 0.18 |
| Colored magenta coupler (CM-2) | 0.05 |
| DIR compound (D-3) | 0.01 |
| High boiling solvent (Oil-3) | 0.5 |
| Gelatin | 1.3 |
| 9th layer: yellow filter layer | |
| Yellow colloidal silver | 0.12 |
| Antistain agent (SC-1) | 0.1 |
| High boiling solvent (Oil-3) | 0.1 |
| Gelatin | 0.8 |
| 10th layer: low-speed blue-sensitive emulsion layer | |
| Silver iodobromide emulsion (Em-1) | 0.30 |
| Silver iodobromide emulsion (Em-2) | 0.25 |
| Sensitizing dye (S-10) | $7 \times 10^{-4}$ (mol/mol Ag) |
| Yellow coupler (Y-1) | 0.6 |
| Yellow coupler (Y-2) | 0.2 |
| DIR compound (D-2) | 0.01 |
| High boiling solvent (Oil-3) | 0.15 |
| Gelatin | 1.2 |
| 11th layer: high-speed blue-sensitive emulsion layer | |
| Silver iodobromide emulsion (Em-4) | 0.50 |
| Silver iodobromide emulsion (Em-2) | 0.22 |
| Sensitizing dye (S-9) | $1.3 \times 10^{-4}$ (mol/mol Ag) |
| Sensitizing dye (S-10) | $3 \times 10^{-4}$ (mol/mol Ag) |
| Yellow coupler (Y-1) | 0.36 |
| Yellow coupler (Y-2) | 0.12 |
| High boiling solvent (Oil-3) | 0.07 |
| Gelatin | 1.2 |
| 12th layer: 1st protective layer | 0.40 |
| Fine grain silver iodobromide emulsion (average grain size: 0.08 μm, AgI: 2.5 mol %) | |
| UV absorbent (UV-1) | 0.10 |
| UV absorbent (UV-2) | 0.05 |
| High boiling solvent (Oil-1) | 0.1 |
| High boiling solvent (Oil-4) | 0.1 |
| Formalin scavenger (HS-1) | 0.5 |
| Formalin scavenger (HS-2) | 0.2 |
| Gelatin | 1.2 |
| 13th layer: 2nd protective layer | |
| Surfactant (Su-1) | 0.005 |
| Alkali-soluble matting agent (average particle size: 2 μm) | 0.10 |
| Cyan dye (AIC-1) | 0.01 |
| Magenta dye (AIM-1) | 0.01 |
| Slipping agent (WAX-1) | 0.04 |
| Gelatin | 0.7 |

Besides the above compositions, coating aid Su-2, dispersing agent Su-3, antiseptic DI-1, stabilizer Stab-1 and antifoggants AF-1 and AF-2 were added in each of the above layer.

Em-1: a monodispersed emulsion containing grains having low surface silver iodide content, an average grain size of 0.46 μm and an average silver iodide content of 7.0 mol %

Em-2: a monodispersed emulsion with uniform composition containing grains having an average grain size of 0.32 μm and an average silver iodide content of 2.5 mol %

Em-3: a monodispersed emulsion containing grains having low surface silver iodide content, an average grain size of 0.78 μm and an average silver iodide content of 6.0 mol %

Em-4: a monodispersed emulsion containing grains having low surface silver iodide content, an average grain size of 0.95 μm and an average silver iodide content of 7.5 mol %

Em-1, Em-3 and Em-4 were silver iodobromide emulsions comprised mainly of octahedral grains each having a multilayer structure prepared by referring to Japanese Pat. O.P.I. Pub. Nos. 138538/1985 and 245151/1986. Em-1 to Em-4 were comprised of grains having average grain-size/grain-thickness ratios of 1.0 and grain size distribution extents of 14%, 10%, 12% and 12%, respectively.

S-1

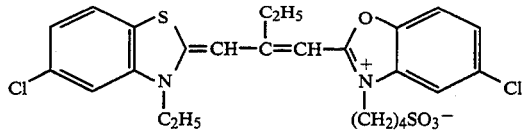

S-2

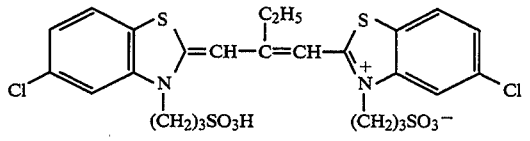

S-3

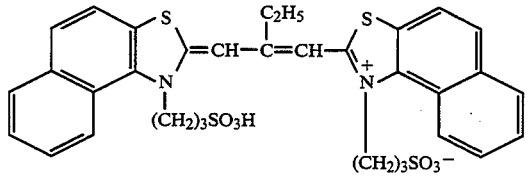

S-4

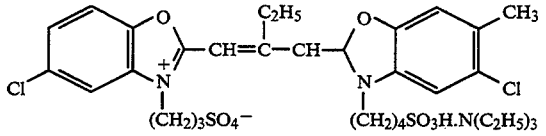

S-5

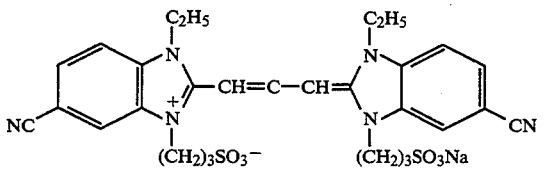

S-6

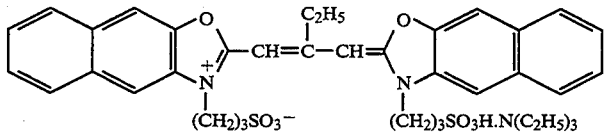

S-7

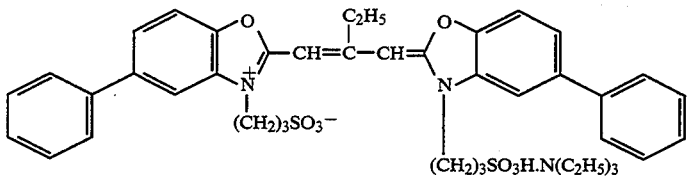

S-8

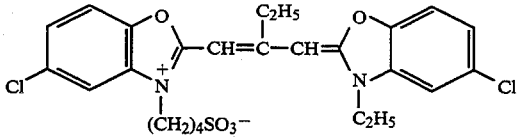

S-9

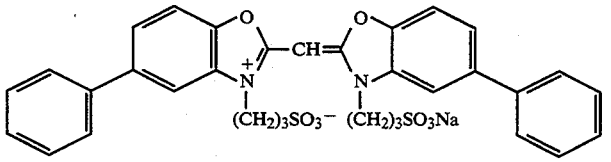

-continued
S-10
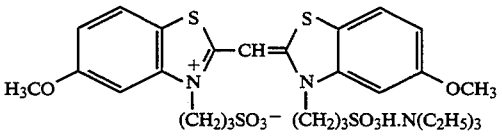
C-1'
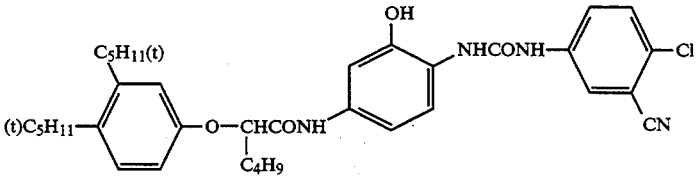
C-2'
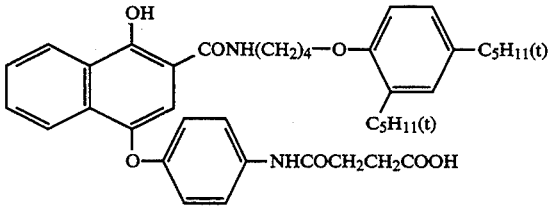
C-3'
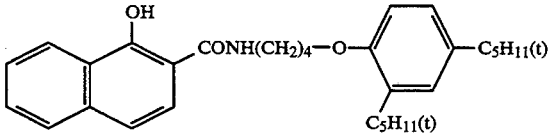
C-4'
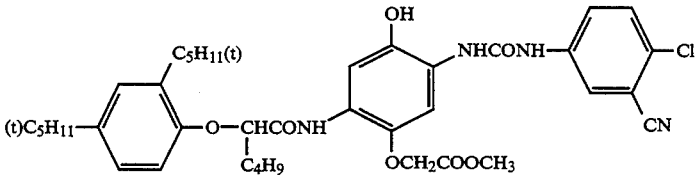
M-1
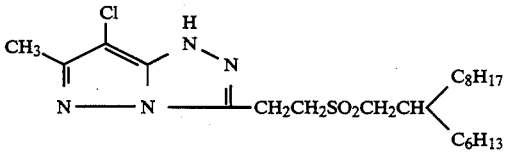
M-2
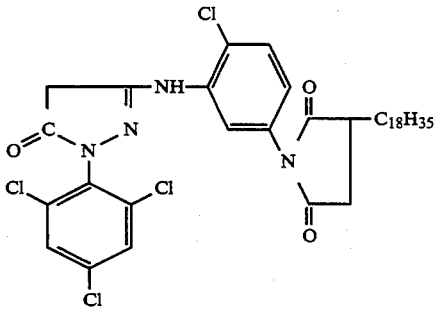

-continued
M-3
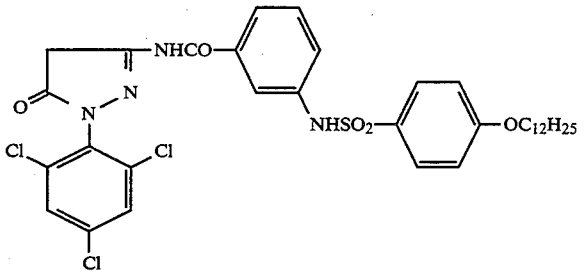
Y-1
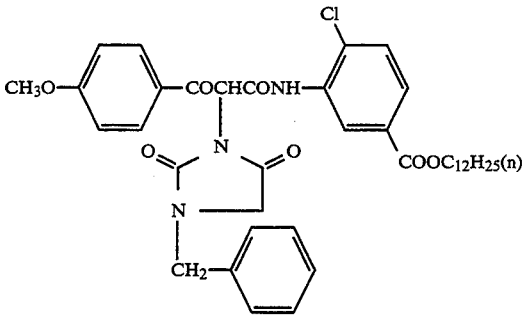
Y-2
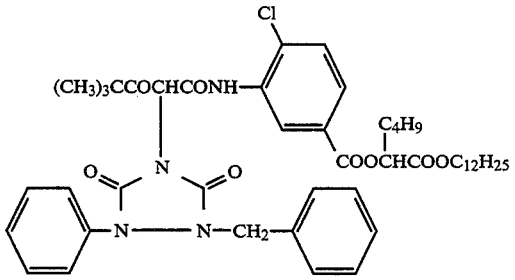
CC-1
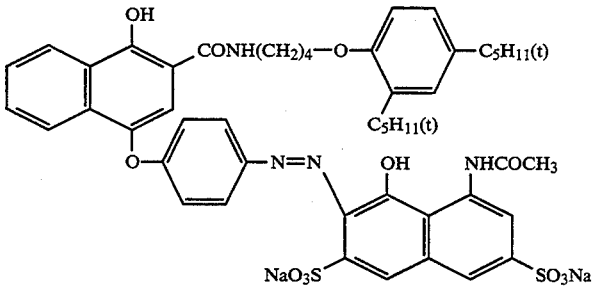
CM-1
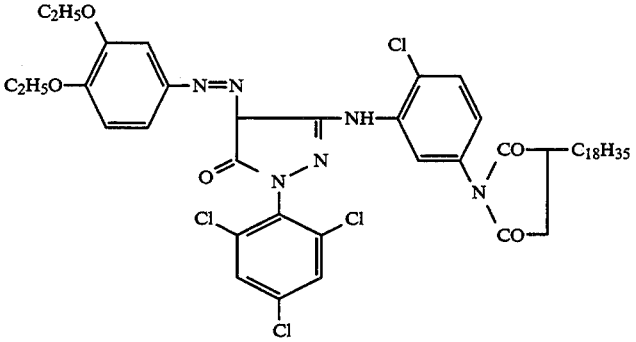

-continued
CM-2
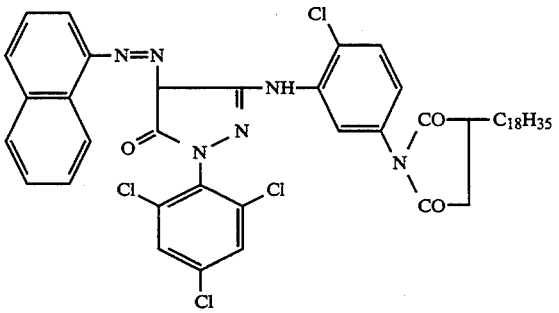
D-1
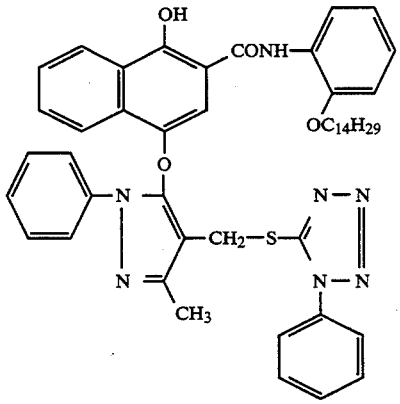
D-2
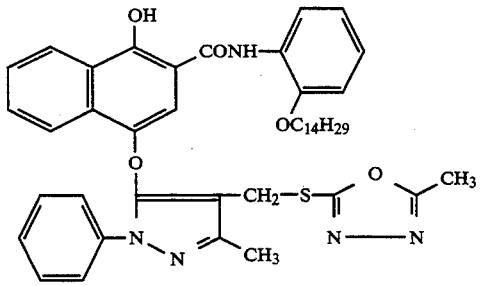
D-3
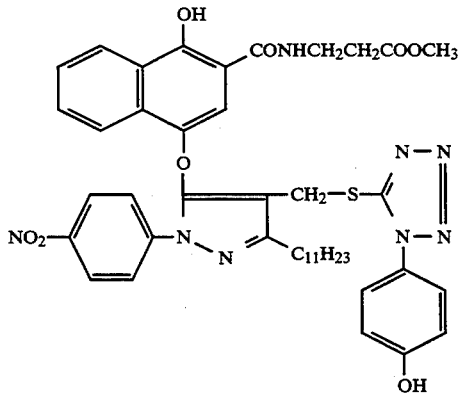

-continued
D-4
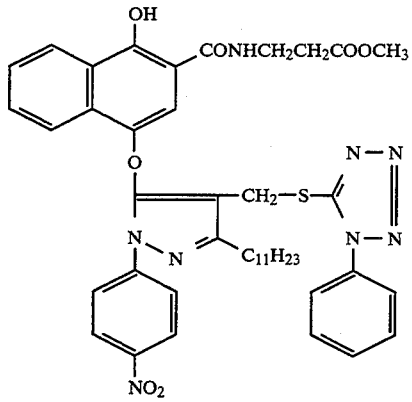
UV-1
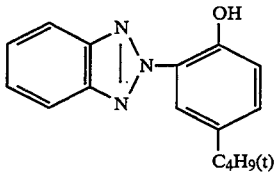
UV-2
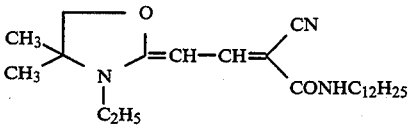
HS-1
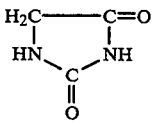
HS-2
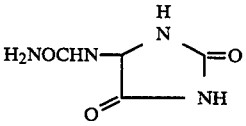
H-1
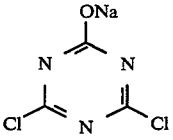
H-2
$((CH_2{=}CHSO_2CH_2)_3CCH_2SO_2(CH_2)_2)_2N$
$(CH_2)_2SO_3K$
Su-1
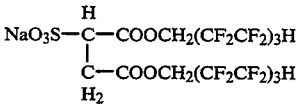
Su-2
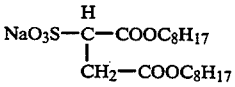
Su-3
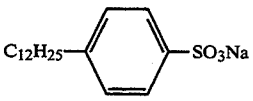

-continued
WAX-1
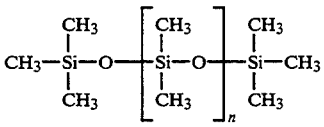
Sc-1
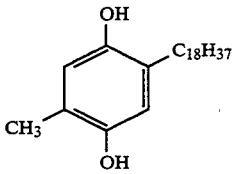
AIC-1
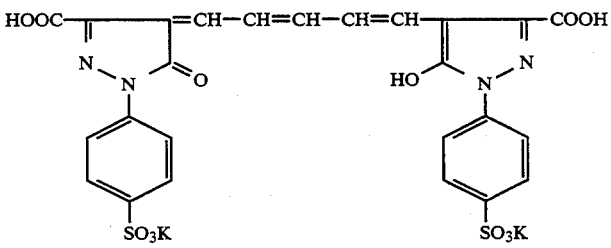
AIM-1
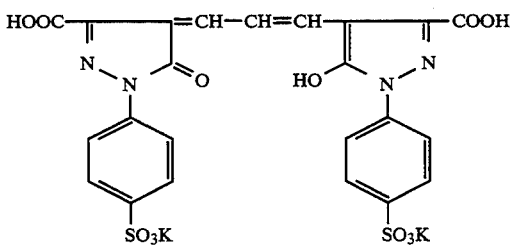
Stab-1
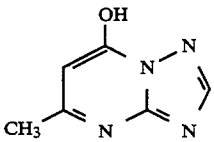
AF-1
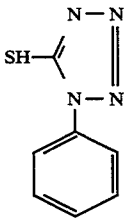
AF-2
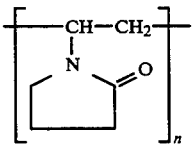
DI-1
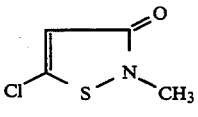
and
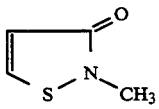
The film sample thus prepared was exposed by photographing with a camera and then subjected to continuous processing under the following conditions:
| Process | Processing Time | Processing Temperature | Replenishing Amount |
|---|---|---|---|
| Color developing | 3 min 15 sec | 38° C. | 720 ml |
| Bleaching | 45 sec | 38° C. | 655 ml |

-continued

| Process | Processing Time | Processing Temperature | Replenishing Amount |
|---|---|---|---|
| Fixing | 1 min 30 sec | 38° C. | 500 ml |
| Stabilizing | 50 sec | 38° C. | 775 ml |
| Drying | 1 min | 40 to 70° C. | |
| (Replenishing amount is per $m^2$ of light-sensitive material) | | | |

The stabilizing was performed in a 2-tank countercurrent mode, in which the stabilizer was fed to the final tank and the overflow was poured into the preceding tank.

| Color developer | |
|---|---|
| Potassium carbonate | 30 g |
| Sodium hydrogencarbonate | 2.5 g |
| Potassium sulfite | 3.0 g |
| Sodium bromide | 1.2 g |
| Potassium iodide | 0.6 mg |
| Hydroxylamine sulfate | 2.5 g |
| Sodium chloride | 0.6 g |
| 4-Amino-3-methyl-N-ethyl-N-(β-hydroxyethyl) aniline sulfate | 4.6 g |
| Diethylenetriaminepentacetic acid | 3.0 g |
| Potassium hydroxide | 1.2 g |

Water was added to make 1 liter, then the pH was adjusted to 10.01 with potassium hydroxide or 20% sulfuric acid.

| Color developing replenisher | |
|---|---|
| Potassium carbonate | 40 g |
| Sodium hydrogencarbonate | 3 g |
| Potassium sulfite | 7 g |
| Sodium bromide | 0.4 g |
| Hydroxylamine sulfate | 3.1 g |
| 4-Amino-3-methyl-N-ethyl-N-(β-hydroxyethyl) aniline sulfate | 6.0 g |
| Diethylenetriaminepentacetic acid | 3.0 g |
| Potassium hydroxide | 2 g |

Water was added to make 1 liter, then the pH was adjusted to 10.20 with potassium hydroxide or 20% sulfuric acid.

| Bleacher | |
|---|---|
| Ammonium ferric 1,3-propylenediaminetetracetate | 0.32 mol |
| Disodium ethylenediaminetetracetate | 10 g |
| Ammonium bromide | 100 g |
| Glacial acetic acid | 40 g |
| Ammonium nitrate | 40 g |

Water was added to make 1 liter, and the pH was adjusted to 4.4 with aqueous ammonia or glacial acetic acid.

| Bleaching replenisher | |
|---|---|
| Ammonium ferric 1,3-propylenediaminetetracetate | 0.35 mol |
| Disodium ethylenediaminetetracetate | 2 g |
| Ammonium bromide | 120 g |
| Ammonium nitrate | 50 g |
| Glacial acetic acid | 40 g |

Water was added to make 1 liter, and the pH was adjusted to 3.4 with aqueous ammonia or glacial acetic acid.

| Fixer and fixing replenisher | |
|---|---|
| Ammonium thiosulfate | 200 g |
| Anhydrous sodium bisulfite | 20 g |
| Sodium metabisulfite | 4.0 g |
| Disodium ethylenediaminetetracetate | 1.0 g |
| Urea | 1.0 g |

Water was added to make 1 liter, then the pH was adjusted to 6.5 with glacial acetic acid and aqueous ammonia.

Stabilizer and stabilizing replenisher

The same stabilizer as that in Example 1 was used.

This continuous processing was run with an automatic processor till the volume of the stabilizing replenisher fed reached three times the capacity of the stabilizing tank.

With the sample subjected to the continuous processing, the magenta density at the maximum density portion was measured. After keeping the sample for 2 weeks at 75° C. and 20% relative humidity, its maximum magenta density was measured again to calculate a fading rate of the dye.

Further, the sample processed as above was checked for backside stains and flaws as well. In addition, the solution in the second stabilizing tank was stored at 25° C. in a beaker having a 50-$cm^2$ opening to determine the residual concentration of a compound expressed by Formula (I) or a comparative compound. The results are shown in Table 7.

In the column of backside stains in Table 7, A indicates no backside stains occurred, B slight backside stains were observed, C obvious backside stains were observed, and D intolerably heavy backside stains were observed.

In the column of flaws in Table 7, A indicates no flaws occurred at all, B flaws occurred very rarely, C flaws occurred at times, and D flaws occurred on most film samples.

TABLE 7

| Compound of Formula (I) or Comparative Compound | Compound of Formula (II) or Comparative Compound | Fading Rate stored at 75° C., 20% RH | Backside stains | Occurance of flaws | Residual Concentration of Compound of Formula (I) or Comparative Compound (%) |
|---|---|---|---|---|---|
| — | — | 48 | D | DD | — |
| Formaldehyde 4.0 ml | — | 8.0 | D | D | 50 |
| Formaldehyde 4.0 ml | II-18 | 7.5 | C | C | 60 |
| Formaldehyde 4.0 ml | Triethanolamine | 8.0 | D | D | 50 |
| Dimethylolurea 3.0 g | — | 28 | DD | DD | 70 |
| Dimethylolurea 3.0 g | II-18 | 27 | D | D | 71 |
| Illustrated Compound (2) | — | 10.5 | C | C | 85 |
| Illustrated Compound (2) | Triethanolamine | 10.0 | C | C | 87 |
| Illustrated Compound (2) | II-18 | 9.0 | A | A | 90 |
| Illustrated Compound (2) | II-19 | 9.0 | A | A | 92 |
| Illustrated Compound (2) | II-20 | 9.0 | A | A | 91 |

TABLE 7-continued

| Compound of Formula (I) or Comparative Compound | Compound of Formula (II) or Comparative Compound | Fading Rate stored at 75° C., 20% RH | Backside stains | Occurance of flaws | Residual Concentration of Compound of Formula (I) or Comparative Compound (%) |
|---|---|---|---|---|---|
| Illustrated Compound (2) | II-23 | 9.5 | B | A | 88 |
| Illustrated Compound (2) | II-24 | 9.0 | A | A | 90 |
| Illustrated Compound (2) | II-40 | 9.5 | B | B | 89 |
| Illustrated Compound (3) | — | 9.5 | C | C | 88 |
| Illustrated Compound (3) | II-18 | 7.5 | A | A | 95 |
| Illustrated Compound (3) | II-19 | 7.5 | A | A | 95 |
| Illustrated Compound (3) | II-20 | 7.5 | B | A | 95 |
| Illustrated Compound (3) | II-23 | 8.0 | B | B | 92 |

TABLE 8

| Compound of Formula (I) or Comparative Compound | Compound of Formula (II) | Fading Rate stored at 75° C., 20% RH | Backside stains | Occurance of flaws | Residual Concentration of Compound of Formula (I) or Comparative Compound (%) |
|---|---|---|---|---|---|
| Illustrated Compound (3) | II-22 | 8.0 | B | A | 90 |
| Illustrated Compound (3) | II-24 | 8.0 | A | A | 92 |
| Illustrated Compound (3) | II-40 | 8.0 | B | A | 91 |
| Illustrated Compound (3) | II-47 | 8.0 | B | B | 92 |
| Illustrated Compound (3) | II-2 | 8.5 | B | B | 90 |
| Illustrated Compound (3) | II-3 | 8.0 | A | A | 90 |
| Illustrated Compound (3) | II-5 | 7.5 | B | A | 95 |
| Illustrated Compound (3) | II-6 | 8.0 | B | A | 90 |
| Illustrated Compound (4) | — | 10.0 | C | C | 86 |
| Illustrated Compound (4) | II-18 | 8.5 | A | A | 92 |
| Illustrated Compound (4) | II-19 | 8.5 | A | A | 92 |
| Illustrated Compound (6) | — | 10.0 | C | C | 86 |
| Illustrated Compound (6) | II-19 | 9.5 | A | A | 89 |
| Illustrated Compound (21) | II-19 | 12 | B | B | 80 |
| Illustrated Compound (49) | II-18 | 12 | A | A | 80 |
| Illustrated Compound (58) | II-18 | 13 | B | B | 80 |

As apparent from the results in Tables 7 and 8, use of formaldehyde in large amounts, through it exerts no adverse effect on the fading rate, causes backside stains and flaws and lowers the residual formaldehyde concentration. Use of conventional substitutes for formaldehyde deteriorates the fading rate under low humidity conditions, causes backside stains and flaws, and lowers the residual concentration. On the other hand, use of the compounds of the invention gives excellent fading rates, particularly under low humidity conditions, and produces excellent results in backside stains and flaws as well as in residual concentrations of the compounds expressed by Formula (I). Example 4

The same procedure as in Example 3 was repeated, except that the stabilizer composition was changed as shown below:

| Stabilizer | |
|---|---|
| 1,2-Benzisothiazoline-3-one | 0.15 g |
| Exemplified compound (3) of Formula (I) | 3.0 g |
| Surfactant amount necessary to give a surface tension shown in Table 9. | |
| Exemplified compound (18) of Formula (II) | 7.0 g |

Water was added to make 1 liter, then the pH was adjusted to 8.5 with sodium hydroxide or sulfuric acid.

The fading rate was evaluated in the same manner as in Example 3. Further, the solution in the second stabilizing tank was stored at 50° C. for 1 week in a beaker having an opening area of 10 $cm^2/l$ to observe formation of oily precipitates. The results are shown in Table 9.

TABLE 9

| Surfactant | Surface Tension | Fading Rate | Degree of Precipitation |
|---|---|---|---|
| Not added | 70 | 8.5% | C |
| SI-14 | 60 | 8.1 | B |
| SI-14 | 45 | 7.6 | B |
| SI-14 | 35 | 7.3 | A |
| SI-14 | 30 | 6.9 | A |
| SII-5 | 60 | 8.2 | B |
| SII-5 | 45 | 8.0 | B |
| SII-5 | 35 | 7.7 | B |
| SII-5 | 30 | 7.5 | A |
| SII-21 | 60 | 8.1 | A |
| SII-21 | 45 | 7.8 | A |
| SII-21 | 35 | 7.3 | A |
| SII-21 | 30 | 6.8 | A |

Example 5

The same procedure as that in Example 2 was repeated, except that 0.05 mol/l each of conventional sulfite-ion-releasing compounds were added to the stabilizer used in Experiment No. 2-31 of Example 3. The magenta fading rate and the backside stain were much the same as those in Example 2, but the preservability of the stabilizer (days till sulfur or sulfides begin precipitating) was increased by about 50%.

Example 6

A continuous processing was run in the same manner as in Example 3, except that the following bleach-fixer was used in place of the bleacher and the fixer in Example 3, and that the following processing conditions were used.

| Process | Processing Time | Processing Temperature | Replenishing Amount |
|---|---|---|---|
| Color developing | 3 min 15 sec | 38° C. | 775 ml |
| Bleach-fixing | 3 min | 38° C. | 650 ml |
| Stabilizing | 1 min | 38° C. | 800 ml |
| Drying | 1 min | 40 to 70° C. | |

| Bleach-fixer and bleach-fixing replenisher | |
|---|---|
| Ammonium thiosulfate | 240 g |
| Ammonium ferric diethylenetriaminepentacetate | 150 g |
| Ammonium thiocyanate | 30 g |
| Ammonium sulfite | 150 g |
| Thiourea | 2 g |
| 2-Amino-5-mercapto-1,3,4-thiadiazole | 2 g |

Water was added to make 1 liter, and the pH was adjusted to 7.0 with acetic acid and aqueous ammonia.

The other experiments, including the preparation of film samples, were the same as those in Example 3. The results were much the same as those in Example 3.

Example 7

A continuous processing was run under the same conditions as in Example 3, except that the following bleacher and bleach-fixer were employed in place of the bleacher and the fixer used in Example 3, that the stabilizing was carried out in a 3-tank countercurrent mode in which a replenisher was fed to the final stabilizing tank and the overflow was poured in the preceding tank, and that an overflow of the bleacher was all poured in the following bleach-fixer tank. The results were about the same as those in Example 3.

| Bleacher and bleaching replenisher | |
|---|---|
| Ammonium ferric ethylenediaminetetracetate | 100 g |
| Ammonium ferric 1,3-propylenediaminetetracetate | 50 g |
| Ammonium bromide | 100 g |
| Ammonium nitrate | 45 g |
| Bleach accelerator | 0.005 mol |

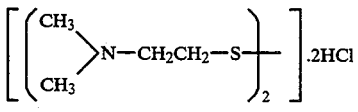

| | |
|---|---|
| Aqueous ammonia (27%) | 12 ml |
| Acetic acid | 5 g |

Water was added to make 1 liter, and the pH was adjusted to 6.0 with aqueous ammonia and acetic acid.

| Bleach-fixer and bleach-fixing replenisher | |
|---|---|
| Ammonium ferric ethylenediaminetetracetate | 50 g |
| Ethylenediaminetetracetic acid | 3 g |
| Ammonium sulfite | 12 g |
| Ammonium thiosulfate | 170 g |
| Ammonium thiocyanate | 70 g |
| Aqueous ammonia (27%) | 4.5 ml |

Water was added to make 1 liter, and the pH was adjusted to 7.2 with aqueous ammonia and acetic acid.

| Process | Processing Time | Processing Temperature | Replenishing Amount |
|---|---|---|---|
| Color developing | 3 min 30 sec | 40° C. | 610 ml |
| Bleaching | 1 min | 38° C. | 460 ml |

-continued

| Process | Processing Time | Processing Temperature | Replenishing Amount |
|---|---|---|---|
| Bleach-fixing | 3 min | 38° C. | 920 ml |
| Stabilizing | 1 min | 35° C. | 800 ml |
| Drying | 1 min | 40 to 70° C. | |

(Replenishing amount is per $m^2$ of light-sensitive material)

Example 8

The following bleacher, bleaching replenisher, fixer and fixing replenisher were prepared.

| Bleacher | |
|---|---|
| Potassium ferric 1,3-propylenediaminetetracetate | 0.32 mol |
| Disodium ethylenediaminetetracetate | 10 g |
| Potassium bromide | 100 g |
| Maleic acid | 30 g |
| Sodium nitrate | 40 g |

Water was added to make 1 liter, and the pH was adjusted to 4.4.

| Bleaching replenisher | |
|---|---|
| Potassium ferric 1,3-propylenediaminetetracetate | 0.35 mol |
| Disodium ethylenediaminetetracetate | 2 g |
| Potassium bromide | 120 g |
| Sodium nitrate | 50 g |
| Maleic acid | 40 g |
| Sodium nitrate | 40 g |

Water was added to make 1 liter, and the pH was adjusted to 3.4.

| Fixer and fixing replenisher | |
|---|---|
| Potassium thiocyanate | 120 g |
| Potassium thiosulfate | 200 g |
| Anhydrous sodium bisulfite | 20 g |
| Sodium metabisulfite | 4.0 g |
| Disodium ethylenediaminetetracetate | 1.0 g |

Water was added to make 1 liter, and the pH was adjusted to 6.5.

Stabilizer and stabilizing replenisher The same stabilizers as those in Experiment Nos. 2-1 to 2-33 of Example 3.

An evaluation made in a similar manner as in Example 3 gave much the same results as in Example 2. The working environment was good and free from unpleasant odors of ammonia and acetic acid.

Besides the effect of the invention, the bleach fog was decreased by 0.01 to 0.03 (transmitted densities of B, G and R) and the desilverizing property was improved by use of the processing solutions free from ammonia and acetic acid.

Example 9

An evaluation was made, in a similar manner as in Example 2, using the same silver halide color light-sensitive material as in Example 3 except that one of the following compounds (BAG 1 to BAG 3) was added in the first layer (antihalation layer) in an amount of 0.015 $g/m^2$. The desilverizing property and the fading rate were improved, other properties were about the same as those in Example 2.

$AgSC_2H_4COOH$ BAG-1

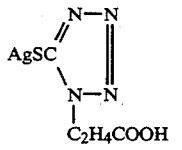

BAG-2

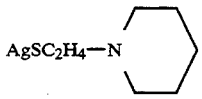

BAG-3

Example 10

An evaluation was made as in Example 1 by use of a stabilizer obtained by removing the antiseptic, 1,2-benzisothiazoline-3-one, from the stabilizer used in Example 1 and stabilizers prepared by replacing 1,2-benzisothiazoline-3-one with benzotriazole or o-phenylphenol and using water deionized with an ion exchange resin (having both strong basicity and strong acidity) to a salt content of magnesium 1.0 ppm and calcium 1.5 ppm. With the stabilizer containing no antiseptic, the period till sulfur or sulfides precipitated was decreased by 2 or 3 days.

This indicates the necessity of an antiseptic in storing the solution. The stabilizers using the other antiseptics or the deionized water exhibited about the same tendency as the stabilizer containing 1,2-benzisothiazoline-3-one.

Example 11

Using the same light-sensitive material as in Example 1, an experiment was made in the same manner as in Example 3 except that the following processing conditions were used.

| Process | Processing Time | Processing Temperature | Replenishing Amount |
|---|---|---|---|
| Color developing | 3 min 15 sec | 38° C. | 775 ml |
| Bleaching | 4 min 20 sec | 38° C. | 155 ml |
| Fixing | 4 min 20 sec | 38° C. | 500 ml |
| Washing | 3 min 15 sec | 18 to 42° C. | 75 ml |
| Stabilizing | 2 min 10 sec | 38° C. | 775 ml |
| Drying | 3 min | 40 to 70° C. | |

Color developer and color developing replenisher

The same as those in Example 3.

| Bleacher | |
|---|---|
| Diammonium ferric 1,3-propylenediaminetetracetate | 0.12 mol |
| 1,3-Propylenediaminetetracetic acid | 5 g |
| Ammonium bromide | 100 g |
| Glacial acetic acid | 50 g |
| Ammonium nitrate | 40 g |

Water was added to make 1 liter, and the pH was adjusted to 3.4 with aqueous ammonia or glacial acetic acid.

| Bleaching replenisher | |
|---|---|
| Diammonium ferric 1,3-propylenediaminetetracetate | 0.17 mol |
| 1,3-Propylenediaminetetracetic acid | 7 g |
| Ammonium bromide | 142 g |
| Glacial acetic acid | 70 g |
| Ammonium nitrate | 57 g |

Water was added to make 1 liter, and the pH was adjusted to 3.4 with aqueous ammonia or glacial acetic acid.

| Fixer | |
|---|---|
| Ammonium thiosulfate | 140 g |
| Anhydrous sodium bisulfite | 20 g |
| Sodium metabisulfite | 40 g |

Water was added to make 1 liter, and the pH was adjusted to 6.5 with glacial acetic acid or aqueous ammonia.

The results on the fading rate, the yellow stain and the backside stain were much the same as those in Example 3.

Example 12

The following concentrated stabilizer composition (concentrated solution) was prepared.

| | |
|---|---|
| 1,2-Benzisothiazoline-3-one | 0.05 g |
| Surfactant (exemplified compound SU-5) | 0.5 g |
| Compound represented by Formula (I) or comparative compound (shown in Table 6) | 2.5 g |
| Compound represented by Formula (II) or comparative compound (shown in Table 6) | 8.0 g |

The pH was adjusted to 9.5 with 40% aqueous solution of KOH. The degree of concentration is shown in Table 10. After preparation, each sample was evaluated in the same manner as in Example 2.

The concentrated composition and its usage are described below. In preparing a replenisher and a ready-to-use processing solution for silver halide color photography, concentrated solutions (or concentrated composition) for them are firstly prepared in general and diluted with water when used. Therefore, the concentration of a concentrated composition for a replenisher is usually 1.5 to 1,000 times as high as that of the objective replenisher. "The degree of concentration of a concentrated composition" means the concentration ratio of a concentrated composition to a composition in a replenisher. In a desirable embodiment of the invention, the degree of concentration is preferably not more than 350, especially not more than 300.

TABLE 10

| Compound of Formula (I) | Compound of Formula (II) or Comparative Compound | Degree of Concentration | Formation of Precipitates | Residual Amount of Compound of Formula (I) | Remarks |
|---|---|---|---|---|---|
| Exemplified compound (2) (inventive compound) | Triethanolamine (comparative compound) | 400 | C | 75 | Comparison |
| Exemplified compound (2) (inventive compound) | Triethanolamine (comparative compound) | 300 | C | 80 | Comparison |

TABLE 10-continued

| Compound of Formula (I) | Compound of Formula (II) or Comparative Compound | Degree of Concentration | Formation of Precipitates | Residual Amount of Compound of Formula (I) | Remarks |
|---|---|---|---|---|---|
| Exemplified compound (2) (inventive compound) | Triethanolamine (comparative compound) | 100 | C | 89 | Comparison |
| Exemplified compound (2) (inventive compound) | Triethanolamine (comparative compound) | 10 | B | 93 | Comparison |
| Exemplified compound (2) (inventive compound) | II-18 (inventive compound) | 400 | A | 95 | Invention |
| Exemplified compound (2) (inventive compound) | II-18 (inventive compound) | 350 | A | 96 | Invention |
| Exemplified compound (2) (inventive compound) | II-18 (inventive compound) | 100 | A | 97 | Invention |
| Exemplified compound (2) (inventive compound) | II-18 (inventive compound) | 10 | A | 97 | Invention |
| Exemplified compound (2) (inventive compound) | I-20 (inventive compound) | 400 | A–B | 93 | Invention |
| Exemplified compound (2) (inventive compound) | I-20 (inventive compound) | 350 | A | 97 | Invention |
| Exemplified compound (2) (inventive compound) | I-20 (inventive compound) | 100 | A | 97 | Invention |
| Exemplified compound (2) (inventive compound) | I-20 (inventive compound) | 10 | A | 96 | Invention |

A: Good
B: Poor
C: Considerably poor

What is claimed is:

1. A stabilizer composition for silver halide color photographic light-sensitive materials comprising at least one compound represented by Formula (I) and at least one compound selected from the group consisting of Formula (II-A), Formula (II-B) and Formula (II-C); wherein Formula (I) is

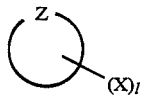

wherein Z represents a group of atoms necessary to form a substituted or unsubstituted homocycle or a substituted or unsubstituted heterocycle, X represents an aldehyde group,

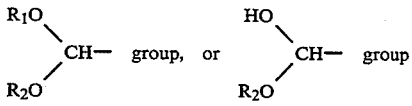

wherein $R_1$ and $R_2$ each represent a $C_2$–$C_4$ alkyl group; 1 represents an integer of 1 to 4, Formula (II-A) is selected from the group consisting of II-1 $CH_3OH$
II-2 $C2H_5OH$
II-3 $CH_3CH_2CH_2OH$
II-4 $CH_3CH(CH_3)OH$
II-5 $HOCH_2CH_2OH$
II-6 $HOCH_2CH_2OCH_3$
II-7 $HOCH_2CH_2OCH_2CH_3$
II-8 $HOCH_2CH_2OCH_2CH_2CH_3$
II-9 $HOCH_2CH_2OCH_2CH_2CH_2CH_3$
II-10 $CH_3OCH_2CH_2OCH_3$
II-11 $C_2H_5OCH_2C_2H_2OC_2H_5$
II-12 $C_3H_7OCH_2CH_2OC_3H_7$
II-13 $C_4H_9OCH_2CH_2OC_4H_9$
II-14 $CH_3OCH_2CH_2OC_2H_5$
II-15 $CH_3OCH_2CH_2OC_3H_7$
II-16 $CH_3OCH_2CH_2OC_4H_9$
II-17 $C_2H_5OCH_2CH_2OC_3H_7$
II-18 $HOCH_2CH_2OCH_2CH_2OH$
II-19 $HOCH_2CH_2OCH_2CH_2OCH_3$
II-20 $HOCH_2CH_2OCH_2CH_2OC_2H_5$
II-21 $HOCH_2CH_2OCH_2CH_2OC_3H_7$
II-22 $HOCH_2CH_2OCH_2CH_4H_9$
II-23 $CH_3OCH_2CH_2OCH_2CH_2OCH_3$
II-24 $C_2H_5OCH_2CH_2OCH_2CH_2OC_2H_5$
II-25 $C_3H_7OCH_2CH_2OCH_2CH_2OC_3H_7$
II-26 $C_4H_9OCH_2CH_2OCH_2CH_2OC_4H_9$
II-27 $CH_3OCH_2CH_2OCH_2CH_2OC_2H_5$
II-28 $CH_3OCH_2CH_2OCH_2CH_2OC_3H_7$
II-29 $CH_3OCH_2CH_2OCH_2CH_2OC_4H_9$
II-30 $C_2H_5OCH_2CH_2OCH_2CH_2OC_3H_7$
II-31 $HOCH_2CH_2CH_2OH$
II-32 $HOCH_2CH_2CH_2OCH_3$
II-33 $HOCH_2CH_2CH_2OC_2H_5$
II-34 $CH_3OCH_2CH_2CH_2OCH_3$
II-35 $HOCH_2CH_2CH_2OC_3H_7$
II-36 $HOCH_2CH_2CH_2CH_2OH$
II-37 $HOCH_2CH_2OCH_2CH_2OCH_2CH_2OH$
II-38 $HOCH_2CH_2OH_2CH_2CH_2OH$
II-39 $HOCH_2CH_2OCH_2CH(OH)CH_2OH$

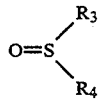

Formula (II-B)

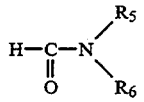

Formula (II-C)

wherein $R_1$ represents $C_1$–$_4$ alkyl group $R_2$ represents a hydrogen atom or a $C_1$–$C_4$ alkyl group, $X_1$ and $X_2$ each represent an alkyleneoxy group or a branched alkyleneoxy group, m and n each represents 0 or an integer of 1 to 100, provided that $m+n \leqq 100$ is satisfied, $R_3$, $R_4$, $R_5$ and $R_6$ each represents a hydrogen atom, a hydroxyl group, a methyl group, an ethyl group, a propyl group, an alkoxyl group, a halogen atom or a hydroxyalkyl group and wherein the substituents on Z are selected from the group consisting of aldehyde, hydroxyl, alkyl, methoxyethyl, benzyl, carboxymethyl, sulfopropyl, aralkyl, alkoxy, halogen, nitro, sulfo, carboxyl, amino, hydroxyalkyl, aryl, cyano, aryloxy, p-carboxyphenyl, acyloxy, acylamino, sulfonamido, sulfamoyl, carbamoyl, and sulfonyl.

2. The stabilizer composition of claim 1, wherein the concentration Formula (I) is within the range of 0.05 to 20 g per liter of said stabilizer composition.

3. The stabilizer composition of claim 1, wherein said stabilizer composition contains an anti-septic agent, wherein said anti-septic agent is at least one compound selected from the compounds consisting of Formula B-1, Formula B-2 and Formula B-3;

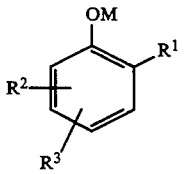

Formula B-1 wherein $R_1$ represents an alkyl group, a cycloalkyl group, an aryl group, a hydroxyl group, an alkoxycarbonyl group, an amino group, a carboxyl group (including its salt) or a sulfo group (including its salt);

$R^2$ and $R^3$ independently represent a hydrogen atom, a halogen atom, an amino group, a nitro group, a hydroxyl group, an alkoxycarbonyl group, a carboxyl group (including its salt) or a sulfo group (including its salt), M represents a hydrogen atom or an alkali metal or an ammonium group;

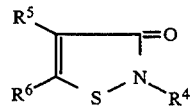

Formula B-2

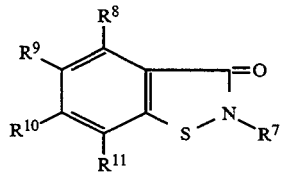

Formula B-3 wherein $R^4$ represents a halogen atom, an alkyl group, an aryl group, a halogenated alkyl group, $—R^{12}—OR^{13}$, $—CONHR^{14}$ (where $R^{12}$ represents an alkylene group, $R^{13}$ and $R^{14}$ each represent a hydrogen atom, an alkyl group or an arylalkyl group) or an arylalkyl group; $R^5$ and $R^6$ each represent a hydrogen atom, a halogen atom, a halogenated alkyl group or alkyl group; $R^7$ represents a hydrogen atom, a halogen atom, an alkyl group, an aryl group, a halogenated alkyl group, an arylalkyl group, $—R^{15}—OR^{16}$, $—CONHR^{17}$ (where $R^{15}$ represents an alkylene group, $R^{16}$ and $R^{17}$ each represent a hydrogen atom, or an alkyl group); and $R^8$, $R^9$, $R^{10}$ and $R^{11}$ each represent a hydrogen atom, a halogen atom, a hydroxyl group, an alkyl group, an amino group or a nitro group.

4. The stabilizer composition of claim 3, wherein the concentration of Formula B-1 is within the range of 0.03 to 50 g per liter of said stabilizer composition.

5. The stabilizer composition of claim 3, wherein the concentration of Formula B-2 or Formula B-3 is within the range of 0.001 to 20 g per liter of said stabilizer composition.

6. The stabilizer composition of claim 1, wherein said compound of Formula I is selected from the group consisting of compounds 1–48 shown in the following table and compounds 49–90 shown in the structures below:

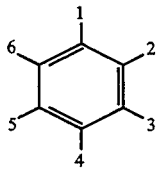

| No. | 1 | 2 | 3 | 4 | 5 | 6 |
|---|---|---|---|---|---|---|
| 1 | CHO | H | H | H | H | H |
| 2 | CHO | H | H | OH | H | H |
| 3 | CHO | H | OH | H | H | H |
| 4 | CHO | OH | H | H | H | H |
| 5 | CHO | OH | H | OH | H | H |
| 6 | CHO | H | OH | H | OH | H |
| 7 | CHO | OH | OH | H | H | H |
| 8 | CHO | H | CHO | H | OH | H |
| 9 | CHO | H | CHO | H | H | OH |
| 10 | CHO | OH | CHO | H | H | H |
| 11 | CHO | H | CHO | H | CHO | H |
| 12 | CHO | OH | CHO | H | CHO | H |
| 13 | $CH(OCH_3)_2$ | H | OH | H | H | H |
| 14 | $CH(OCH_3)_2$ | H | H | OH | H | H |
| 15 | $CH(OCH_3)_2$ | H | OH | H | OH | H |
| 16 | CHO | H | $NO_2$ | H | H | H |
| 17 | CHO | H | H | $NO_2$ | H | H |
| 18 | CHO | $NO_2$ | H | H | H | H |
| 19 | CHO | H | $NO_2$ | H | $NO_2$ | H |

-continued

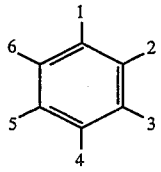

| No. | 1 | 2 | 3 | 4 | 5 | 6 |
|---|---|---|---|---|---|---|
| 20 | CHO | H | H | $OCH_3$ | H | H |
| 21 | CHO | H | $OCH_3$ | H | OH | H |
| 22 | CHO | H | OH | $OCH_3$ | H | H |
| 23 | CHO | H | $OCH_3$ | OH | H | H |
| 24 | CHO | H | OH | $OCH_3$ | OH | H |
| 25 | CHO | H | Cl | H | H | H |
| 26 | CHO | H | H | Cl | H | H |
| 27 | CHO | H | Cl | H | Cl | H |
| 28 | CHO | H | COOH | COOH | H | H |
| 29 | CHO | H | Br | H | H | H |
| 30 | CHO | H | H | Br | H | H |
| 31 | CHO | H | OH | $SO_3H$ | H | H |
| 32 | CHO | H | H | $NH_2$ | H | H |
| 33 | CHO | H | H | $N(CH_3)_2$ | H | H |
| 34 | CHO | H | H | $N(C_2H_6)_2$ | H | H |
| 35 | CHO | H | H | $CONH_2$ | H | H |
| 36 | CHO | H | H | $SO_2NH_2$ | H | H |
| 37 | CHO | H | H | $SO_3H$ | H | H |
| 38 | CHO | H | H | CN | H | H |
| 39 | CHO | H | H | $COOCH_3$ | H | H |
| 40 | CHO | H | H | COOH | H | H |
| 41 | CHO | H | $SO_3H$ | H | H | H |
| 42 | CHO | H | COOH | H | H | H |
| 43 | CHO | H | CN | H | H | H |
| 44 | CHO | H | $COOCH_3$ | H | H | H |
| 45 | CHO | H | $CONH_2$ | H | H | H |
| 46 | $CH(OH)(OCH_3)$ | H | OH | H | H | H |
| 47 | $CH(OH)(OCH_3)$ | H | H | OH | H | H |
| 48 | CHO | H | OH | $CH_3$ | H | H |

49

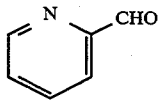

50

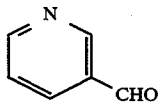

51

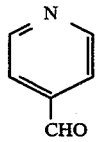

52

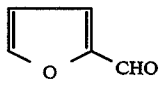

53

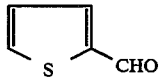

-continued
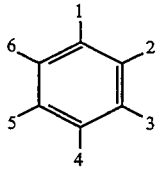
| No. | 1 | 2 | 3 | 4 | 5 | 6 |
|---|---|---|---|---|---|---|
| 54 | | | | 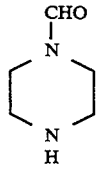 | | |
| 55 | | | | 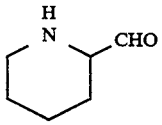 | | |
| 56 | | | | 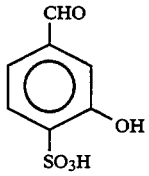 | | |
| 57 | | | | 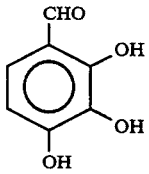 | | |
| 58 | | | | 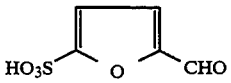 | | |
| 59 | | | | 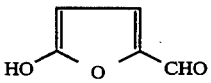 | | |
| 60 | | | | 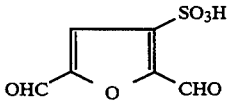 | | |
| 61 | | | | 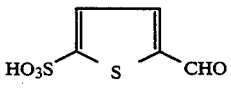 | | |
| 62 | | | | 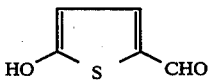 | | |
| 63 | | | | 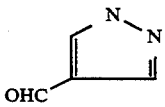 | | |
| 64 | | | | 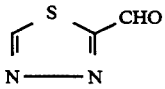 | | |

-continued
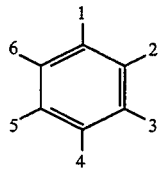
| No. | 1 | 2 | 3 | 4 | 5 | 6 |
|---|---|---|---|---|---|---|
| 65 | | | 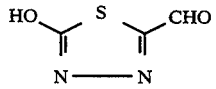 | | | |
| 66 | | | 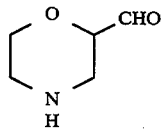 | | | |
| 67 | | | 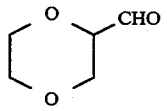 | | | |
| 68 | | | 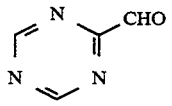 | | | |
| 69 | | | 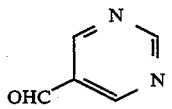 | | | |
| 70 | | | 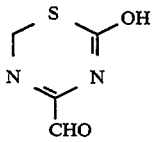 | | | |
| 71 | | | 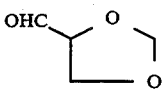 | | | |
| 72 | | | 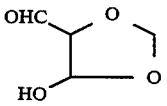 | | | |
| 73 | | | 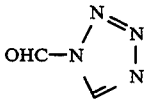 | | | |
| 74 | | | 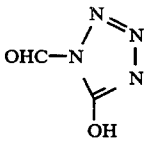 | | | |
| 75 | | | 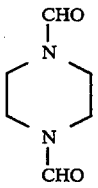 | | | |

-continued
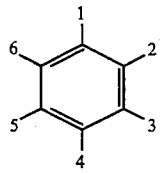
| No. | 1 | 2 | 3 | 4 | 5 | 6 |
|---|---|---|---|---|---|---|
| 76 | | | | | | |
| 77 | | | | | | |
| 78 | | | | | | |
| 79 | | | | | | |
| 80 | | | | | | |
| 81 | | | | | | |
| 82 | | | | | | |
| 83 | | | | | | |
| 84 | | | | | | |

-continued
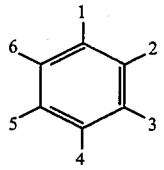
| No. | 1 | 2 | 3 | 4 | 5 | 6 |
|---|---|---|---|---|---|---|
| 85 | | | | 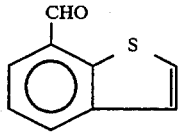 | | |
| 86 | | | | 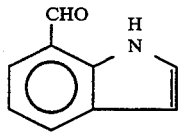 | | |
| 87 | | | | 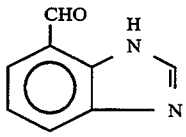 | | |
| 88 | | | | 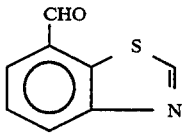 | | |
| 89 | | | | 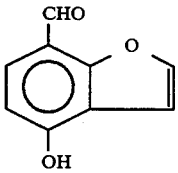 | | |
| 90 | | | | 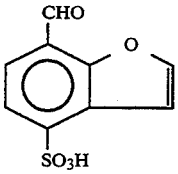 | | |
7. The stabilizer composition of claim 6 wherein the at least one compound of formula (II-A), (II-B) and (II-C) is selected from the group consisting of
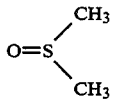
II-40
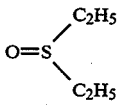
II-41
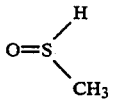
II-42
-continued
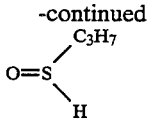
II-43
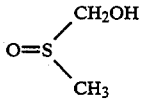
II-44
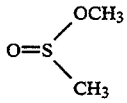
II-45
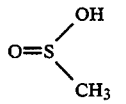
II-46

-continued

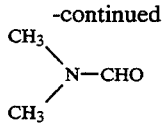

II-47

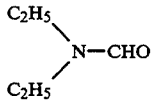

II-48

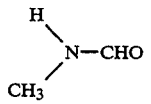

II-49

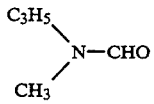

II-50

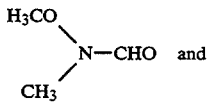

II-51

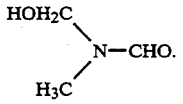

II-52

8. The stabilizer composition of claim 1 comprising at least one compound represented by Formula (I) and at least one compound selected from Formula (II-B) or Formula (II-C);

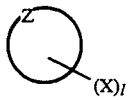

Formula (I)

wherein Z represents a group of atoms necessary to form a substituted or unsubstituted homocycle or a substituted or unsubstituted heterocycle, X represents an aldehyde group,

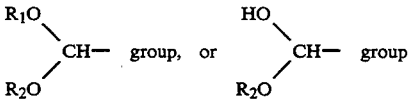

wherein $R_1$ and $R_2$ each represents a lower alkyl group; l represents an integer of 1 to 4,

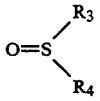

Formula (II-B)

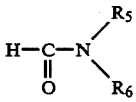

Formula (II-C)

wherein $R_3$, $R_4$, $R_5$ and $R_6$ each represents a hydrogen atom, a hydroxyl group, a methyl group, an ethyl group, a propyl group, an alkoxyl group, a halogen atom or a hydroxyalkyl group and wherein the substituents on Z are selected from the group consisting of aldehyde, hydroxyl, alkyl, methoxyethyl, benzyl, carboxymethyl, sulfopropyl, aralkyl, alkoxy, halogen, nitro, sulfo, carboxyl, amino, hydroxyalkyl, aryl, cyano, aryloxy, p-carboxyphenyl, acyloxy, acylamino, sulfonamido, sulfamoyl, carbamoyl, and sulfonyl.

9. A stabilizer composition for silver halide color photographic light-sensitive materials comprising at least one compound sensitive materials comprising at least one compound represented by Formula (I) and at least one compound selected from the group consisting of Formula (II-A), Formula (II-B) and Formula (II-C);

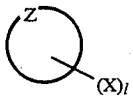

Formula (I)

wherein Z represents a group of atoms necessary to form a substituted or unsubstituted homocycle or a substituted or unsubstituted heterocycle, X represents an aldehyde group,

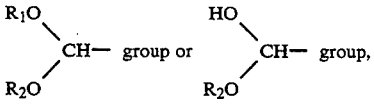

wherein $R_1$ and $R_2$ each represents a $C_1$–$C_4$ alkyl group; l represents an integer of 1 to 4,

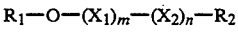

Formula (II-A)

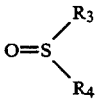

Formula (II-B)

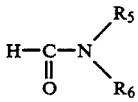

Formula (II-C)

wherein $R_1$ represents a $C_1$–$C_4$ alkyl group and $R_2$ represents a hydrogen atom or a $C_1$–$C_4$ alkyl group, $X_1$ and $X_2$ each represent an alkyleneoxy group or a branched alkyleneoxy group, m and n each represent 0 or an integer of 1 to 100, provided that $m+n \leqq 100$ is satisfied, $R_3$, $R_4$, $R_5$ and $R_6$ each represent a hydrogen atom, a hydroxyl group, a methyl, ethyl or propyl group, an alkoxyl group, a halogen atom or a hydroxyalkyl group, and water in an amount to form a concentrated solution wherein the compound of Formula (I) is present in an amount of 0.5 to 4 g per 10 ml of the concentrated solution and wherein the substituents on Z are selected from the group consisting of aldehyde, hydroxyl, alkyl, methoxyethyl, benzyl, carboxymethyl, sulfopropyl, aralkyl, alkoxy, halogen, nitro, sulfo, carboxyl, amino, hydroxyalkyl, aryl, cyano, aryloxy, p-carboxyphenyl, acyloxy, acylamino, sulfonamido, sulfamoyl, carbamoyl, and sulfonyl.

10. A stabilizer composition for silver halide color photographic light-sensitive materials comprising 0 to 0.2 g formaldehyde per liter of stabilizer composition; at least one compound represented by Formula (I); and at least one compound selected from the group consisting of Formula (II-A), Formula (II-B) and Formula (II-C);

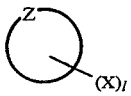

Formula (I)

wherein Z represents a group of atoms necessary to form a substituted or unsubstituted homocycle or a substituted or unsubstituted heterocycle, X represents an aldehyde group,

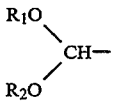

group,

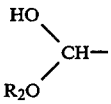

group wherein $R_1$ and $R_2$ each represent a $C_2$–$C_4$ alkyl group; l represents an integer of 1 to 4, $$R_1-O-(X_1)_m-(X_2)_n-R_2$$

Formula (II-A)

-continued

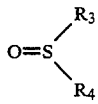

Formula (II-B)

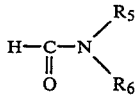

Formula (II-C)

wherein $R_1$ represents a $C_1$–$C_4$ alkyl group, $R_2$ represents a hydrogen atom or a $C_1$–$C_4$ alkyl group, $X_1$ and $X_2$ each represent an alkyleneoxy group or a branched alkyleneoxy group, m and n each represents 0 or an integer of 1 to 100, provided that $m+n \leqq 100$ is satisfied, $R_3$, $R_4$, $R_5$ and R6 each represents a hydrogen atom, a hydroxyl group, a methyl group an ethyl group, a propyl group, an alkoxyl group, a halogen atom or a hydroxyalkyl group and wherein the substituents on Z are selected from the group consisting of aldehyde, hydroxyl, alkyl, methoxyethyl, benzyl, carboxymethyl, sulfopropyl, aralkyl, alkoxy, halogen, nitro, sulfo, carboxyl, amino, hydroxyalkyl, aryl, cyano, aryloxy, p-carboxyphenyl, acyloxy, acylamino, sulfonamido, sulfamoyl, carbamoyl, and sulfonyl.

11. The stabilizer composition of claim 10 for silver halide color photographic light-sensitive materials wherein said compound of Formula (I) is selected from the group consisting of compounds 1–48 shown in the following table and compounds 49–90 shown in the structure below:

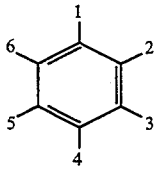

| No. | 1 | 2 | 3 | 4 | 5 | 6 |
|---|---|---|---|---|---|---|
| 1 | CHO | H | H | H | H | H |
| 2 | CHO | H | H | OH | H | H |
| 3 | CHO | H | OH | H | H | H |
| 4 | CHO | OH | H | H | H | H |
| 5 | CHO | OH | H | OH | H | H |
| 6 | CHO | H | OH | H | OH | H |
| 7 | CHO | OH | OH | H | H | H |
| 8 | CHO | H | CHO | H | OH | H |
| 9 | CHO | H | CHO | H | H | OH |
| 10 | CHO | OH | CHO | H | H | H |
| 11 | CHO | H | CHO | H | CHO | H |
| 12 | CHO | OH | CHO | H | CHO | H |
| 13 | $CH(OCH_3)_2$ | H | OH | H | H | H |
| 14 | $CH(OCH_3)_2$ | H | H | OH | H | H |
| 15 | $CH(OCH_3)_2$ | H | OH | H | OH | H |
| 16 | CHO | H | $NO_2$ | H | H | H |
| 17 | CHO | H | H | $NO_2$ | H | H |
| 18 | CHO | $NO_2$ | H | H | H | H |
| 19 | CHO | H | $NO_2$ | H | $NO_2$ | H |
| 20 | CHO | H | H | $OCH_3$ | H | H |
| 21 | CHO | H | $OCH_3$ | H | OH | H |
| 22 | CHO | H | OH | $OCH_3$ | H | H |
| 23 | CHO | H | $OCH_3$ | OH | H | H |
| 24 | CHO | H | OH | $OCH_3$ | OH | H |
| 25 | CHO | H | Cl | H | H | H |
| 26 | CHO | H | H | Cl | H | H |
| 27 | CHO | H | Cl | H | Cl | H |
| 28 | CHO | H | COOH | COOH | H | H |
| 29 | CHO | H | Br | H | H | H |
| 30 | CHO | H | H | Br | H | H |

-continued
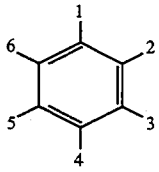
| No. | 1 | 2 | 3 | 4 | 5 | 6 |
|---|---|---|---|---|---|---|
| 31 | CHO | H | OH | $SO_3H$ | H | H |
| 32 | CHO | H | H | $NH_2$ | H | H |
| 33 | CHO | H | H | $N(CH_3)_2$ | H | H |
| 34 | CHO | H | H | $N(C_2H_6)_2$ | H | H |
| 35 | CHO | H | H | $CONH_2$ | H | H |
| 36 | CHO | H | H | $SO_2NH_2$ | H | H |
| 37 | CHO | H | H | $SO_3H$ | H | H |
| 38 | CHO | H | H | CN | H | H |
| 39 | CHO | H | H | $COOCH_3$ | H | H |
| 40 | CHO | H | H | COOH | H | H |
| 41 | CHO | H | $SO_3H$ | H | H | H |
| 42 | CHO | H | COOH | H | H | H |
| 43 | CHO | H | CN | H | H | H |
| 44 | CHO | H | $COOCH_3$ | H | H | H |
| 45 | CHO | H | $CONH_2$ | H | H | H |
| 46 | $CH(OH)(OCH_3)$ | H | OH | H | H | H |
| 47 | $CH(OH)(OCH_3)$ | H | H | OH | H | H |
| 48 | CHO | H | OH | $CH_3$ | H | H |
| 49 | 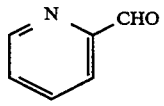 | | | | | |
| 50 | 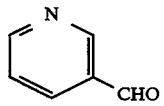 | | | | | |
| 51 | 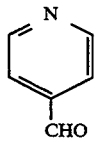 | | | | | |
| 52 | 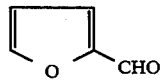 | | | | | |
| 53 | 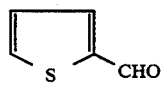 | | | | | |
| 54 | 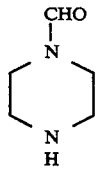 | | | | | |

-continued
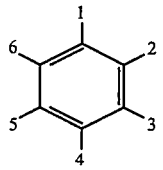
| No. | 1 | 2 | 3 | 4 | 5 | 6 |
|---|---|---|---|---|---|---|
| 55 | | | | 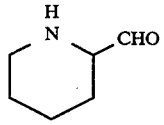 | | |
| 56 | | | | 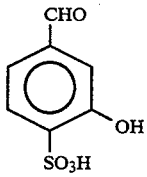 | | |
| 57 | | | | 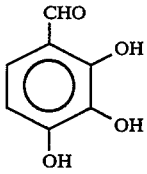 | | |
| 58 | | | | 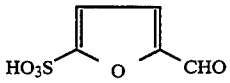 | | |
| 59 | | | | 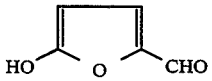 | | |
| 60 | | | | 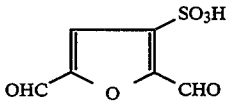 | | |
| 61 | | | | 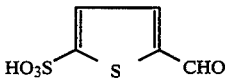 | | |
| 62 | | | | 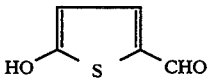 | | |
| 63 | | | | 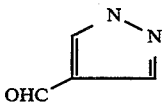 | | |
| 64 | | | | 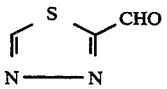 | | |
| 65 | | | | 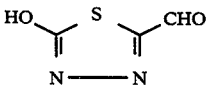 | | |

-continued
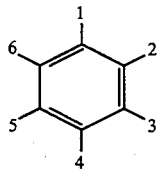
| No. | 1 | 2 | 3 | 4 | 5 | 6 |
|---|---|---|---|---|---|---|
| 66 | | | | 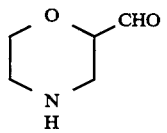 | | |
| 67 | | | | 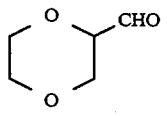 | | |
| 68 | | | | 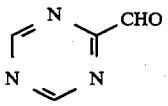 | | |
| 69 | | | | 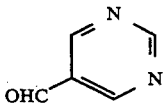 | | |
| 70 | | | | 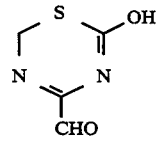 | | |
| 71 | | | | 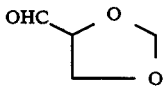 | | |
| 72 | | | | 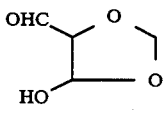 | | |
| 73 | | | | 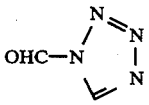 | | |
| 74 | | | | 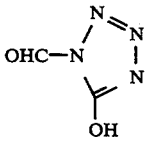 | | |
| 75 | | | | 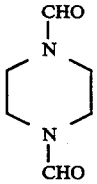 | | |

-continued
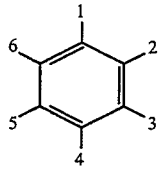
| No. | 1 | 2 | 3 | 4 | 5 | 6 |
|---|---|---|---|---|---|---|
| 76 | | | CHO | | | |
| 77 | | | CHO | OH | | OH |
| 78 | | | CHO | OH | | |
| 79 | | | CHO | | | OH |
| 80 | | | CHO | | | OH |
| 81 | | | CHO | | | $SO_3H$ |
| 82 | | | CHO | | | $SO_3H$ |
| 83 | | | CHO | N | | |
| 84 | | | CHO | O | | |

-continued

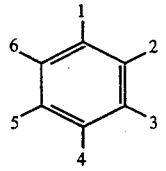

| No. | 1 | 2 | 3 | 4 | 5 | 6 |
|---|---|---|---|---|---|---|
| 85 | | | | 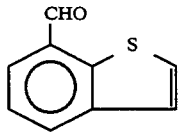 | | |
| 86 | | | | 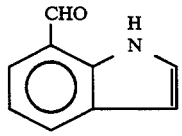 | | |
| 87 | | | | 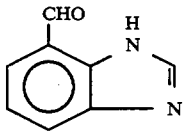 | | |
| 88 | | | | 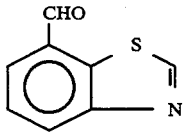 | | |
| 89 | | | | 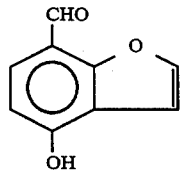 | | |
| 90 | | | | 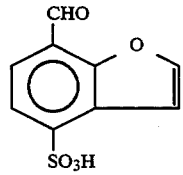 | | |

12. The stabilizer composition of claim 11 further comprising water to form a concentrated solution wherein the compound of Formula (I) is present in an amount of 0.5 g to 4 g per 10 ml of solution.

13. The stabilizer composition of claim 11 wherein the compound of Formula (II-A) is at least one compound selected from the group consisting of:

| | |
|---|---|
| $CH_3CH_2CH_2OH$ | II-3 |
| $HOCH_2CH_2OH$ | II-5 |

-continued

| | |
|---|---|
| $HOCH_2CH_2OCH_3$ | II-6 |
| $HOCH_2CH_2OCH_2CH_2OH$ | II-18 |
| $HOCH_2CH_2OCH_2CH_2OCH_3$ | II-19 |
| $HOCH_2CH_2OCH_2CH_2OC_2H_5$ | II-20 |
| $HOCH_2CH_2OCH_2CH_2OC_4H_9$ | II-22 |
| $CH_3OCH_2CH_2OCH_2CH_2OCH_3$ and | II-23 |
| $C_2H_5OCH_2CH_2OCH_2CH_2OC_2H_5$. | II-24 |

* * * * *